US007325911B2

(12) United States Patent
Katayama et al.

(10) Patent No.: US 7,325,911 B2
(45) Date of Patent: Feb. 5, 2008

(54) INK CARTRIDGE AND INKJET RECORDING APPARATUS

(75) Inventors: Naoki Katayama, Kariya (JP); Bing Wang, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 405 days.

(21) Appl. No.: 10/951,781

(22) Filed: Sep. 29, 2004

(65) Prior Publication Data

US 2005/0104942 A1 May 19, 2005

(30) Foreign Application Priority Data

Sep. 30, 2003 (JP) ..... 2003-338930
Nov. 10, 2003 (JP) ..... 2003-379814

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS 6,033,063 A 3/2000 Tomikawa et al.
6,036,306 A 3/2000 Haigo
6,170,939 B1 1/2001 Ujita et al.
6,217,164 B1 4/2001 Hino
6,543,886 B1 * 4/2003 Hattori et al. ..... 347/85
2002/0060725 A1 5/2002 Shinada et al.
2002/0149646 A1 10/2002 Pawlowski, Jr. et al.

FOREIGN PATENT DOCUMENTS

CN 1358137 A 7/2002
EP 1 000 753 A1 5/2000
EP 1 164 025 A1 12/2001
EP 1 403 062 A1 3/2004
JP A 2001-113723 4/2001
JP A 2001-328279 11/2001

* cited by examiner

*Primary Examiner*—An H. Do
(74) *Attorney, Agent, or Firm*—Oliff & Berridge, PLC

(57) ABSTRACT

An ink cartridge has an ink tank for reserving ink and a joint connected to the ink tank, the joint including an outer frame having an ink channel, and a sealing member made of an elastic material and received in the outer frame, the sealing member having a cylindrical portion and a valve portion. When an ink supply pipe having an ink inlet is inserted into the cylindrical portion, the cylindrical portion abuts against an outer circumference of the ink supply pipe on an ink flow downstream side of the ink supply pipe with respect to the ink inlet. The valve portion leaves the outer frame so as to open the ink channel when the ink supply pipe is inserted into the cylindrical portion, and when the ink supply pipe is not inserted into the cylindrical portion, the valve portion abuts against the outer frame to close the ink channel.

16 Claims, 11 Drawing Sheets

INK CARTRIDGE AND INKJET RECORDING APPARATUS

BACKGROUND OF THE INVENTION

1. Field of the Invention

The present invention relates to an ink cartridge for supplying ink to an inkjet head of inkjet recording apparatus for ejecting ink to thereby perform printing.

2. Description of the Related Art

An ink cartridge is to supply reserved ink to an ink-jet head of inkjet recording apparatus. The ink supplied from the ink cartridge is distributed into a plurality of pressure chambers by the inkjet head, which selectively applies pulsed pressure to the pressure chambers so as to eject the ink from nozzles. The ink cartridge is removably attached to the inkjet head. When all the ink reserved in the ink cartridge is used up, the ink cartridge is replaced by a new ink cartridge reserving ink, and then disposed of by a user.

As an example of such an ink cartridge, there is known an ink cartridge in which a packing, a valve and a spring are provided in an ink channel communicating with the outside (see JP-A-2001-328279 (FIG. 1)). When the ink cartridge is not attached to the inkjet head, the valve is urged onto the packing by the spring so as to close the ink channel. When the ink cartridge is attached to the inkjet head, the valve is pressed to leave the packing by an ink supply needle communicating with the inside of the inkjet head, so as to open the ink channel. According to this ink cartridge, there is no fear that the ink reserved in the ink cartridge leaks out when the ink cartridge is not attached to the inkjet head, while the reserved ink is supplied to the inkjet head when the ink cartridge is attached to the inkjet head through the supply needle.

JP-A-2001-113723 (FIG. 4., etc.) discloses an ink cartridge having a valve and a spring to selectively change over from disconnection to connection or from connection to disconnection between an ink chamber for reserving ink and the outside. In this ink cartridge, a cylindrical packing forming an insertion path of an ink supply needle is pressed into an ink supply port for securing communication between the ink chamber and the outside. An ink guide chamber is formed on the ink chamber side by the cylindrical packing. The valve and the spring for urging the valve to keep elastic contact with the cylindrical packing are disposed in the ink guide chamber.

When the ink cartridge is attached to inkjet recording apparatus, the ink supply needle passes the insertion path of the cylindrical packing and abuts against the valve. Thus, the valve is moved toward the ink chamber so that an ink channel is formed between the ink chamber and the ink supply needle. In this event, the inner circumferential surface of the insertion path of the cylindrical packing abuts against the outer circumferential surface of the ink supply needle so that ink in the ink chamber can be prevented from leaking from the insertion path of the cylindrical packing. On the other hand, when the ink cartridge is detached from the inkjet recording apparatus, the valve is urged by the spring to elastically abut against the cylindrical packing. Thus, the valve is seated on the cylindrical packing so as to close the insertion path. As a result, the ink in the ink chamber can be prevented from leaking to the outside through the insertion path.

SUMMARY OF THE INVENTION

The used ink cartridge in which all the reserved ink has been used up is disposed of by a user as described previously. However, it is difficult for the user to dispose of the used ink cartridge as combustible garbage because the spring made of metal is incorporated in the ink cartridge. Even when an agent takes care of the ink cartridge, there is a problem that it costs to disassemble the ink cartridge and separate the spring therefrom.

Also, in the aforementioned ink cartridge, it is necessary to provide a plurality of parts, that is, the cylindrical packing elastically abutting against the valve, the spring, and the valve in order to selectively change over from disconnection to connection or from connection to disconnection between the ink chamber and the outside. Thus, there is a problem that not only is the structure complicated, but the man-hour for assembling also increases, so that the cost increases.

It is therefore an object of the invention to provide an ink cartridge which can be disposed of easily as combustible garbage by a user when it has been used up.

Another object of the invention is to provide an ink cartridge which can selectively change over from disconnection to connection or from connection to disconnection between an ink chamber and the outside with a reduced number of parts and a simple structure.

According to one aspect of the present invention, there is provided an ink cartridge including: an ink tank for reserving ink; and a joint connected to the ink tank, the joint including an outer frame having an ink channel formed to secure communication between the ink tank and the outside, and a sealing member made of an elastic material and received in the outer frame, the sealing member having a cylindrical portion and a valve portion; wherein when an ink supply pipe having an ink inlet is inserted into the cylindrical portion, the cylindrical portion abuts against an outer circumference of the ink supply pipe on an ink flow downstream side of the ink supply pipe with respect to the ink inlet, so as to close the ink channel; and the valve portion abuts against the outer frame so as to close the ink channel when the ink supply pipe is not inserted into the cylindrical portion, and the valve portion leaves the outer frame so as to open the ink channel when the ink supply pipe is inserted into the cylindrical portion.

According to the invention, since the ink channel is closed by the elastic force of an elastic material, a metal elastic body used in the conventional ink cartridge is eliminated. Accordingly, an ink cartridge in which the number of metal members is reduced in comparison with that in the conventional art can be attained. It becomes easy for a user to dispose of the ink cartridge as combustible garbage when it has been used up.

According to another aspect of the invention, there is provided an ink cartridge including: an ink tank for reserving ink; and a joint connected to the ink tank, the joint including an outer frame having an atmosphere channel formed to secure communication between the ink tank and the outside, and a sealing member made of an elastic material and received in the outer frame, the sealing member having a cylindrical portion and a valve portion; wherein when an atmosphere introduction pipe having an atmosphere outlet is inserted into the cylindrical portion, the cylindrical portion abuts against an outer circumference of the atmosphere introduction pipe on a gas flow upstream side of the atmosphere introduction pipe with respect to the atmosphere outlet, so as to close the atmosphere channel; and the valve portion abuts against the outer frame so as to close the atmosphere channel when the atmosphere introduction pipe is not inserted into the cylindrical portion, while the valve portion leaves the outer frame so as to open the atmosphere channel when the atmosphere introduction pipe is inserted into the cylindrical portion. According to the invention, the atmosphere channel is closed by the elastic force of an elastic material. Therefore, a metal elastic body used in the conventional ink cartridge is eliminated. Accordingly, an ink cartridge in which the number of metal members is reduced in comparison with that in the conventional art can be attained. It becomes easy for the user to dispose of the ink cartridge as combustible garbage when it has been used up.

According to still another aspect of the invention, there is provided an ink cartridge including: an ink chamber for reserving ink; an ink supply chamber to which an ink supply member is capable of being inserted for supplying the ink from the ink chamber to the outside; a first communication hole for securing communication between the ink chamber and the ink supply chamber; and an elastic sealing member including an outer circumferential portion and an intermediate portion, the outer circumferential portion being substantially in close contact with an inner wall surface of the ink supply chamber substantially parallel to an axial direction of the ink supply chamber extending in an insertion direction of the ink supply member, the intermediate portion being movable within the ink supply chamber and extending in a direction crossing the axial direction so as to be connected with the outer circumferential portion; wherein the outer circumferential portion of the sealing member is substantially in close contact with the inner wall surface of the ink supply chamber so as to close the first communication hole; and upon insertion of the ink supply member into the ink supply chamber, the ink supply member bends and deforms the intermediate portion in the axial direction substantially with the center of the intermediate portion as a vertex, so that the outer circumferential portion leaves the inner wall surface of the ink supply chamber so as to make the first communication hole communicate with the ink supply member.

In this ink cartridge, when the ink supply member is not inserted into the ink supply chamber, the outer circumferential portion of the sealing member is substantially in contact with the inner circumferential surface of the ink supply chamber so as to close the first communication hole securing communication between the ink chamber and the ink supply chamber. Accordingly, disconnection can be set between the ink chamber and the outside. On the other hand, when the ink supply member is inserted into the ink supply chamber, the sealing member is bent and deformed in the axial direction substantially with the center of the intermediate portion as a vertex, so that the outer circumferential portion of the sealing member leaves the inner wall surface of the ink supply chamber. Accordingly, the first communication hole is opened to secure communication between the ink chamber and the ink supply member. In addition, the sealing member is an elastic body. Therefore, when the ink supply member is pulled out, the outer circumferential portion of the sealing member is restored to its shape such that the outer circumferential portion is brought substantially into close contact with the inner wall surface of the ink supply chamber. Thus, the first communication hole is closed again so that disconnection can be set between the ink chamber and the outside. In such a manner, a plurality of parts such as a cylindrical packing, a valve and a coil spring as in the background art are not required. There is an effect that connection and disconnection between the ink chamber and the outside can be selectively changed over with a simple structure and simply by providing the sealing material in the ink supply chamber.

BRIEF DESCRIPTION OF THE DRAWINGS

The present invention may be more readily described with reference to the accompanying drawings.

DETAILED DESCRIPTION OF THE PREFERRED EMBODIMENTS

A first embodiment of the invention will be described below with reference to the drawings.

Figure 1:
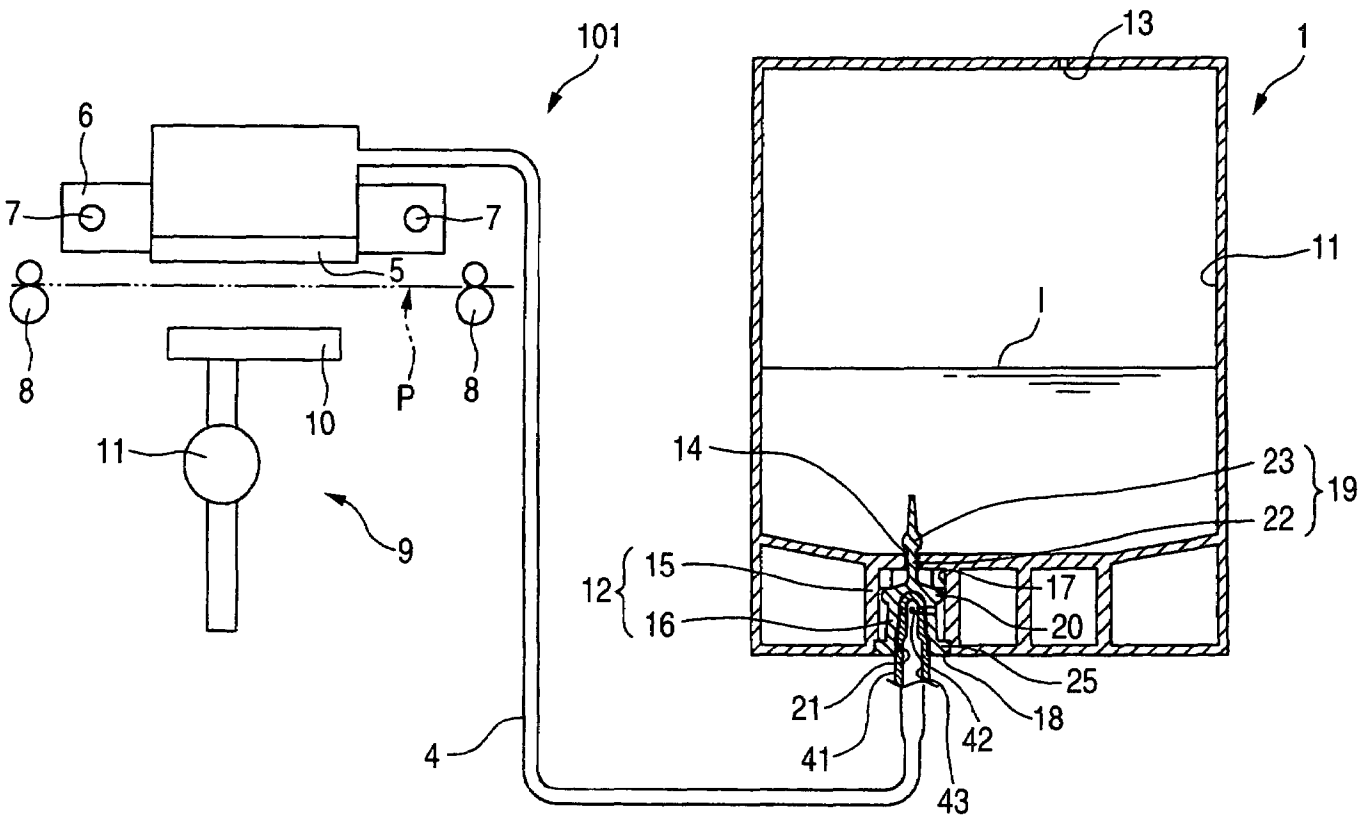
FIG. 1 is a partial schematic view of an ink cartridge according to a first embodiment of the invention, and an ink-jet recording apparatus mounted with the ink cartridge.
Figure 2B:
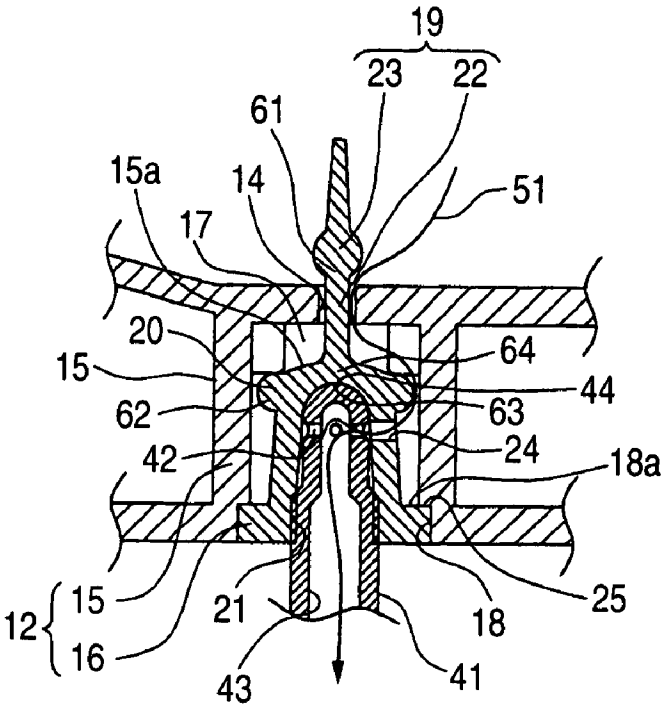
FIGS. 2A and 2B are sectional views of a joint portion shown in FIG. 1.
Figure 2A:
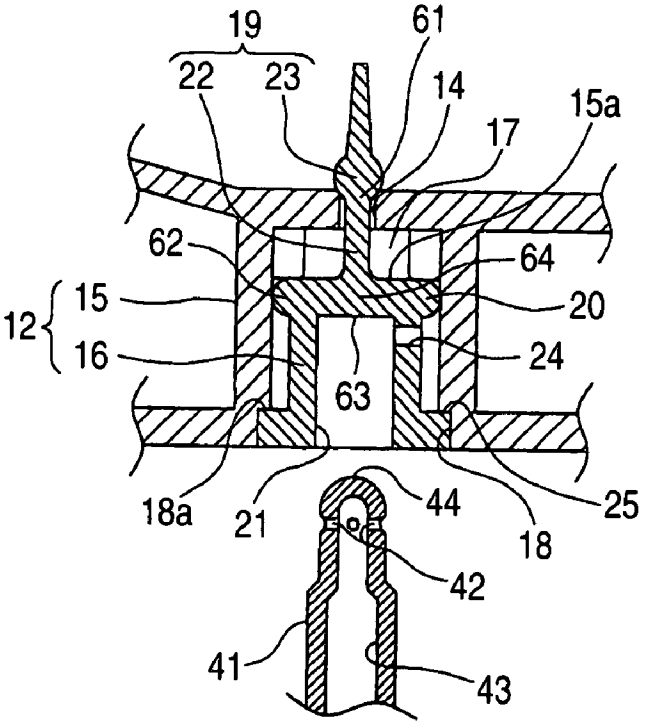

FIG. 1 is a partial schematic view of an inkjet recording apparatus including an ink cartridge according to the first embodiment. Incidentally, the ink cartridge 1 is shown by its sectional structure. In addition, FIGS. 2A and 2B are partial enlarged views of the ink cartridge shown in FIG. 1. As shown in FIG. 1, an inkjet recording apparatus 101 includes an ink-jet head S for ejecting ink toward recording paper P, the ink cartridge 1 for reserving ink (I in FIG. 1) to be ejected by the ink-jet head 5, a carriage 6 for reciprocating the inkjet head 5 straightly in one direction (a direction perpendicular to the paper of FIG. 1) along guides 7, conveyance mechanisms 8 for conveying the recording paper P in a direction perpendicular to the moving direction of the inkjet head 5 and in parallel to the ink ejection surface of the inkjet head 5, and a purging unit 9 for sucking air or high-viscosity ink in the inkjet head 5. The purging unit 9 is disposed further outside the recording paper P on the driving track of the inkjet head 5. The purging unit 9 has a purging cap 10 and a suction pump 11. The purging cap 10 can move in the direction where the purging cap 10 approaches/leaves the ink ejection surface of the inkjet head 5. The purging cap 10 is mounted on the ink ejection surface of the inkjet head 5. The suction pump 11 is provided for sucking ink.

In this inkjet recording apparatus 101, ink reserved in the ink cartridge 1 is supplied to the inkjet head 5 through a supply tube 4. The inkjet head 5 is reciprocated by the carriage 6 while ejecting ink from nozzles onto the recording paper P conveyed by the conveyance mechanisms 8. Thus, a desired image is formed on the recording paper P. Whenever a predetermined time has passed, the inkjet head 5 is moved onto the purging cap 10 of the purging unit 9 by the carriage 6, and the purging cap 10 is then moved to abut against the ink ejection surface of the inkjet head 5. In this state, the suction pump 11 is driven to suck air or high-viscosity ink from the nozzles of the ink-jet head 5.

Next the inkjet head 5 and the ink cartridge 1 will be described in detail. The inkjet head 5 has an ink ejection surface in which a large number of nozzles for ejecting ink are formed. The inkjet head 5 is controlled by a not-shown control unit so that the ink supplied from the ink supply tube 4 is ejected from the nozzles. The ink supply tube 4 has one end portion connected to the inkjet head 5, and the other end portion connected to an ink supply pipe 41 made from synthetic resin. The ink supply pipe 41 is a pipe having a tapered shape and connected to the ink cartridge 1. The ink supply pipe 41 has a plurality of ink inlets 42 and an internal ink channel 43. The ink inlets 42 are formed along the circumference of a semispherical portion 44 at the front end of the sealed pipe. The internal ink channel 43 communicates with the outside through the ink inlets 42.

The ink cartridge 1 is a substantially rectangular parallelepiped casing formed out of synthetic resin, having an ink tank 11 for reserving ink (I in FIG. 1) and a joint portion 12 for connecting the ink supply pipe 41 thereto. The ink tank 11 is a space which is defined by the inner wall of the ink cartridge 1 and which is to be filled with ink. The ink tank 11 has an atmosphere inlet channel 13 and an ink outlet channel 14. The atmosphere inlet channel 13 is a channel formed in the top surface of the ink tank 11 and for securing communication between the ink tank 11 and the atmosphere so as to introduce the atmosphere in accordance with the ink flowing out from the ink outlet channel 14. The ink outlet channel 14 is a channel formed in the bottom surface of the ink tank 11 and for allowing the ink to flow out. The ink outlet channel 14 secures communication between the ink tank 11 and the internal space of the joint portion 12.

The joint portion 12 has an outer frame 15 and a sealing member 16. The outer frame 15 is constituted by the inner wall of the ink cartridge 1. The sealing member 16 is disposed in the internal space of the outer frame 15. The outer frame 15 has an ink channel 17 and an insertion hole 18. The ink channel 17 is the internal space of the outer frame 15, and the insertion hole 18 is an opening in the bottom surface of the outer frame 15. That is, the ink channel 17 communicates with the ink tank 11 through the ink outlet channel 14, while communicating with the outside through the insertion hole 18. In addition, as shown in FIGS. 2A and 2B, a counter boring 18*a* for bringing the outer frame 15 and the sealing member 16 into engagement is formed in the insertion hole 18.

The sealing member 16 is a rubber (flexible resin) member molded integrally for opening or blocking the ink channel 17 in accordance with connection or disconnection to the ink supply pipe 14. The sealing member 16 has an expansion valve 19, a plate-like valve 20, a cylindrical portion 21 and a closing portion 25. As is apparent from FIGS. 2A and 2B, the sealing member 16 has a shape that as a whole can be molded integrally by insert molding. The expansion valve 19 is a valve having an expansion portion 23 and a support portion 22. The expansion portion 23 is larger than the outer diameter of the opening of the ink outlet channel 14. The support portion 22 supports the expansion portion 23. The expansion portion 23 is disposed in the ink outlet channel 14 inside the ink tank 11. The support portion 22 passes through the ink outlet channel 14 and extends vertically. The plate-like valve 20 is a valve having a disc-like shape whose outer diameter is slightly larger than the inner diameter of the ink channel 17 in the horizontal direction (a direction perpendicular to the insertion direction of the ink supply pipe 41). In addition, the vicinity of the outer edge of the plate-like valve 20 is supported, from the ink tank 1 side, on a seat 15*a* formed in the ink channel 17. The cylindrical portion 21 has a cylindrical shape such that the outer circumferential surface of the ink supply pipe 41 is brought into close contact with the inner circumferential surface of the cylindrical portion 21 so as to seal up the outer circumference of the ink supply pipe 41. In addition, the cylindrical portion 21 has a sealing member ink channel 24 for making the internal ink channel 43 and the ink channel 17 communicate with each other through the ink inlets 42 of the ink supply pipe 41 in close contact with the cylindrical portion 21. The closing portion 25 engages with the counter boring 18*a* formed in the insertion hole 18 of the outer frame 15, so as to close the ink channel 17. As described above, the constituent parts of the ink cartridge 1 are made from rubber or synthetic resin. That is, the ink cartridge 1 is formed out of only combustible materials.

Next, the operation of the joint portion 12 will be described in detail with reference to FIGS. 2A and 2B. FIGS. 2A and 2B are enlarged views of the joint portion 12 in FIG. 1. FIG. 2A shows the state where the ink supply pipe 41 is not connected to the joint portion 12, and FIG. 2B shows the state where the ink supply pipe 41 has been connected to the joint portion 12. The arrow 51 in FIG. 2B illustrates the flow of ink.

As shown in FIG. 2A, when the ink supply pipe 41 is not connected to the joint portion 12, the expansion portion 23 of the expansion valve 19 of the sealing member 16 is pulled into the ink channel 17 due to elastic force applied to the support portion 22 in a contraction direction. The lower portion (closing portion 61) of the expansion portion 23 is displaced to a position (closing position) where it is in close contact with the opening portion of the ink outlet channel 14 on the ink tank 11 side. Thus, the ink outlet channel 14 is closed. In this event, since the expansion portion 23 itself has elasticity, the expansion portion 23 and the ink-tank-side opening portion of the ink outlet channel 14 are brought into close contact with each other with no space therebetween due to the elasticity of the expansion portion 23. Further, the plate-like valve 20 of the sealing member 16 applies its own elastic force in its extending direction onto its circumferential edge (closing portion 62) so that the circumferential edge is displaced in a position (closing position) where the circumferential edge is horizontally in close contact with the inner wall of the ink channel 17. In this event, since the circumferential edge of the plate-like valve 20 has an elastic force in itself, the circumferential edge of the plate-like valve 20 and the inner wall of the ink channel 17 are brought into close contact with each other with no space therebetween due to the elastic force. As a result, the ink channel 17 is closed so that there is no fear that ink reaches the sealing member ink channel 24 of the sealing member 16.

On the other hand, when the ink supply pipe 41 is connected to the joint portion 12 as shown in FIG. 2B, the semispherical portion 44 in the front end of the inserted ink supply pipe 41 abuts against the vicinity (to-be-pressed portion 63) of the center of the opposite surface of the plate-like valve 20 of the sealing member 16 to the ink tank 11. When the ink supply pipe 41 is further pressed, the central portion (deformation portion 64) of the plate-like valve 20 is elastically deformed to be convex on the ink tank 11 side in accordance with the curved shape of the semispherical portion 44. When the deformation portion 64 is elastically deformed to be convex on the ink tank 11 side, the support portion 22 is pushed up toward the ink tank 11. When the support portion 22 is pushed up, the closing portion 61 of the expansion portion 23 supported by the support portion 22 and closing the opening portion of the ink outlet channel 14 on the ink tank 11 side is also displaced to a position (separation position) where the closing portion 61 is pushed up on the ink tank 11 side. Thus, the opening portion of the ink outlet channel 14 on the ink tank 11 side is opened. At the same time, when the deformation portion 64 is elastically deformed to be convex on the ink tank 11 side, the closing portion 62 of the plate-like valve 20 brought horizontally in close contact with the inner wall of the ink channel 17 due to its own elastic force is displaced to a position (separation position) where the closing portion 62 leaves the inner wall of the ink channel 17 so as to follow the seat formed in the ink channel 17 and supporting the closing portion 61, to thereby open the ink channel 17.

When the expansion valve 19 and the plate-like valve 20 open the ink channel 17, the ink reserved in the ink tank 11 flows into the ink channel 17 through the ink outlet channel 14. In this event, the closing portion 25 of the sealing member 16 is in engagement with and in close contact with the counter boring formed in the insertion hole 18 of the outer frame 15. Accordingly, there is no fear that the ink flowing into the ink channel 17 leaks out from a gap between the outer frame 15 and the sealing member 16. The ink flowing into the ink channel 17 flows into the sealing member ink channel 24, and further flows into the internal ink channel 43 through the ink inlets 42 of the ink supply pipe 41. In this event, since the cylindrical portion 21 seals up the outer circumference of the ink supply pipe 41, there is no fear that the ink flowing into the sealing member ink channel 24 leaks out from a gap between the sealing member 16 and the ink supply pipe 41. The ink flowing into the internal ink channel 43 is supplied to the inkjet head 5 through the ink supply tube 4. After that, when the ink supply pipe 41 is pulled out from the joint portion 12 so as to be released from connection thereto, the deformation portion 64 of the plate-like valve 20 is restored to its initial shape shown in FIG. 2A due to its own elastic force. In response thereto, the expansion portion 23 and the closing portion 62 return to the closing positions so as to close the ink outlet channel 14 and the ink channel respectively.

In this event, the expansion portion 23 and the closing portion 62 can return to their closing positions immediately if the semispherical portion 44 is separated from the to-be-pressed portion 63 of the plate-like valve 20. It is therefore possible to close the channels 14 and 17 before the ink supply pipe 41 is perfectly pulled out. Thus, ink leakage due to the pulling-out of the ink supply pipe 41 can be prevented.

In the first embodiment described above, the expansion valve 19 and the plate-like valve 20 close the ink outlet channel 14 and the ink channel 17 due to the elastic forces of the expansion valve 19 and the plate-like valve 20 themselves. Accordingly, a metal elastic body such as a spring used in the conventional ink cartridge is eliminated. Further, the ink cartridge 1 is thoroughly made from synthetic resin and rubber. Thus, the user can dispose of the used ink cartridge 1 as combustible garbage.

In addition, the single sealing member 16 molded integrally can produce three functions, that is, a function of sealing the inserted ink supply pipe 41 so as to prevent ink from leaking from the periphery of the ink supply pipe 41, a function of coming in close contact with the ink outlet channel 14 and the ink channel 17 so as to close these channels with no ink leakage therefrom when the ink supply pipe 41 is not inserted, and a function of changing over the ink outlet channel 14 and the ink channel 17 from open states to closed states respectively as soon as the ink supply pipe 41 is pulled out. Thus, the number of parts is reduced in comparison with that in the background-art ink cartridge, so that the cost can be reduced on a large scale.

Since the sealing member 16 is molded integrally, the manufacturing cost of the ink cartridge 1 can be reduced.

In addition, since the sealing member 16 closes the ink channel 17 doubly by means of the expansion valve 19 and the plate-like valve 20, the ink channel 17 can be closed surely.

Since engagement can be made easily between the closing portion 25 of the sealing member 16 and the counter boring 18*a* formed in the insertion hole 18 of the outer frame 15, the manufacturing cost of the ink cartridge can be reduced.

In addition, the ink outlet channel 14 is closed from the inside of the ink tank 11 by the expansion portion 19 disposed inside the ink tank 11. Due to this configuration, ink leakage can be surely prevented even if there occurs an extreme change in environment from a normal use environment. That is, the internal pressure of the ink tank 11 is extremely higher than the external pressure (atmospheric pressure) in an environment in a region where there is a wide range of temperature between day and night, on an airplane, or the like. In such a situation, ink suffers enough pressure to leak from the ink tank 11. In this event, however, the expansion portion 19 suffers the internal pressure of the ink tank 11 so as to be brought into closer contact with the ink-tank-side opening portion of the ink outlet channel 14. Thus, the closing operation of the expansion portion 19 is enhanced so that ink leakage can be prevented.

Figure 3:
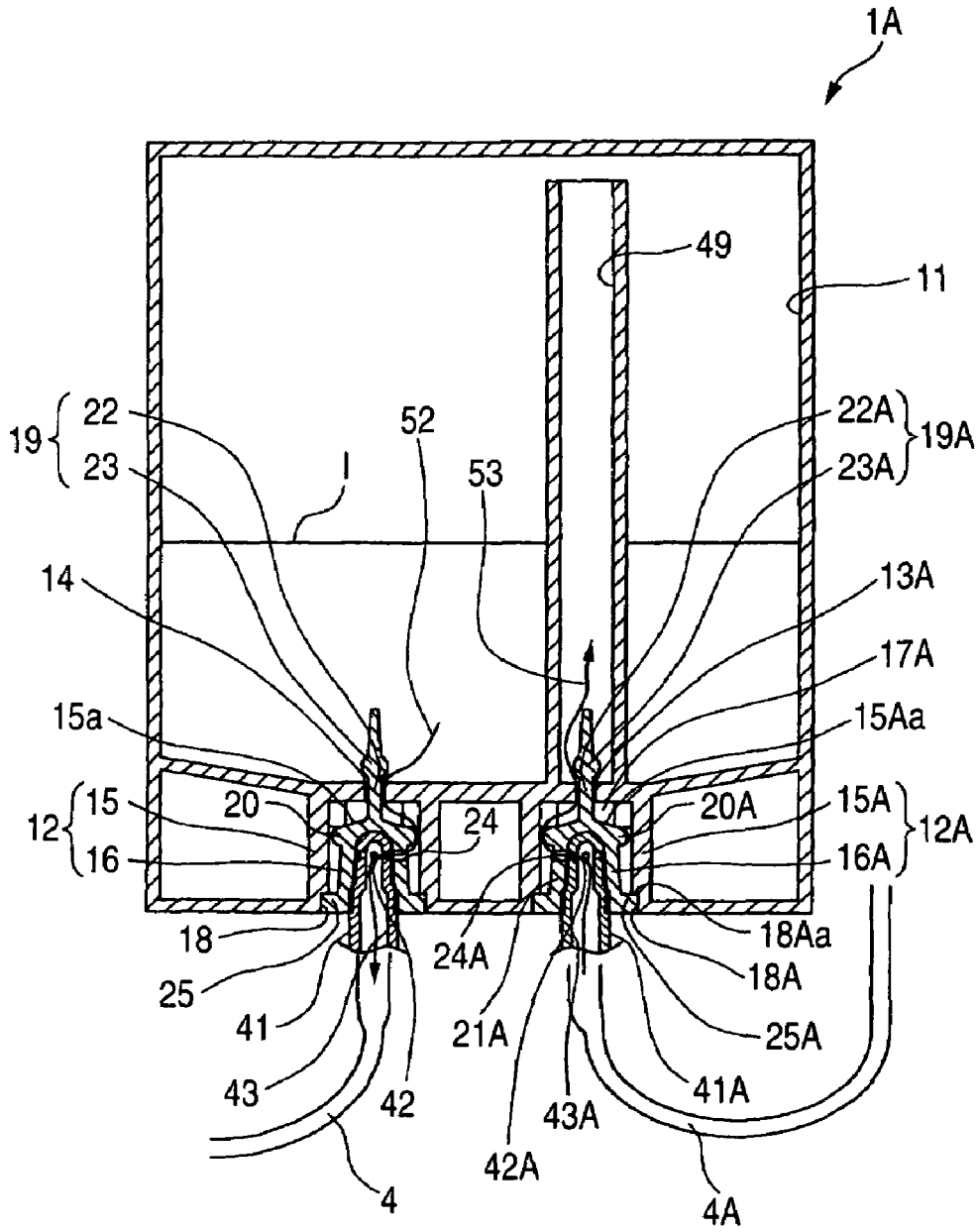
FIG. 3 is a sectional view of an ink cartridge according to a second embodiment.

Next, other embodiments of the invention will be described in turn below, but a part of description as to configurations, operations and behaviors similar to those in the first embodiment will be omitted. First, an ink cartridge according to a second embodiment of the invention will be described with reference to FIG. 3. FIG. 3 is a sectional view of the ink cartridge according to the second embodiment. Incidentally, the arrow 52 in FIG. 3 illustrates the flow of ink, and the arrow 53 illustrates the flow of the atmosphere.

Incidentally, the ink cartridge according to the second embodiment is applied to the inkjet recording apparatus 101 described in the first embodiment. Therefore, in the drawings related to the second embodiment, members the same as those in the first embodiment are denoted by the same reference numerals correspondingly, and description thereof will be omitted.

An ink cartridge 1A is a substantially rectangular parallelepiped casing formed out of synthetic resin, having an ink tank 11 for reserving ink (I in FIG. 3), a joint portion 12 for connecting an ink supply pipe 41 made from synthetic resin, and a joint portion 12A for connecting an atmosphere introduction pipe 41A for introducing the atmosphere. The ink tank 11 is a space defined by the inner wall of the ink cartridge 1A. The ink tank 11 has an atmosphere inlet channel 13A, an atmosphere guide channel 49 and an ink outlet channel 14. The atmosphere inlet channel 13A is a channel formed in the bottom surface of the ink tank 11 and for securing communication between the ink tank 11 and the atmosphere so as to introduce the atmosphere in accordance with the ink flowing out from the ink outlet channel 14. In addition, the atmosphere inlet channel 13A secures communication between the atmosphere guide channel 49 and the internal space of the joint portion 12A. The atmosphere guide channel 49 is a cylindrical channel through which the atmosphere flowing in from the atmosphere inlet channel 13A is guided to the vicinity of the top surface of the ink tank 11. Due to provision of the atmosphere guide channel 49, the atmosphere flowing into the ink tank 11 is prevented from passing through the ink reserved therein. Thus, the ink can be prevented from bubbling due to the introduction of the atmosphere. The ink outlet channel 14 is a channel formed in the bottom surface of the ink tank 11 and for allowing the ink to flow out. The ink outlet channel 14 secures communication between the ink tank 11 and the internal space of the joint portion 12.

The details of the joint portion 12 are substantially equivalent to those of the joint portion 12 according to the first embodiment, and detailed description thereof will be omitted.

The joint portion 12A has an outer frame 15A formed out of the inner wall of the ink cartridge 1A, and a sealing member 16A disposed in the internal space of the outer frame 15A. The outer frame 15A has an atmosphere channel 17A which is the internal space of the outer frame 15A, and an insertion hole 18A which is an opening portion of the bottom surface. That is, the atmosphere channel 16A communicates with the ink tank 11 through the atmosphere inlet channel 13A while communicating with the outside through the insertion hole 18A. In addition, a counter boring 18Aa for bringing the outer frame 15A and the sealing member 16A into close-contact engagement is formed in the insertion hole 18A.

The sealing member 16A is a rubber (flexible resin) member molded integrally for opening or blocking the atmosphere channel 17A in accordance with connection or disconnection to the atmosphere introduction pipe 41A made from synthetic resin. The sealing member 16A has an expansion valve 19A, a plate-like valve 20A, a cylindrical portion 21A and a closing portion 25A. The expansion valve 19A has an expansion portion 23A and a support portion 22A. The expansion portion 23A is larger than the outer diameter of the opening of the atmosphere inlet channel 13A. The support portion 22A supports the expansion portion 23A. The expansion valve 19A is a valve disposed in the atmosphere inlet channel 13A inside the ink tank 11. The support portion 22A passes through the atmosphere inlet channel 13A and extends vertically. The plate-like valve 20A is a valve having a disc-like shape whose outer diameter is slightly larger than the inner diameter of the atmosphere channel 17A in the horizontal direction. In addition, the vicinity of the outer edge of the plate-like valve 20A is supported, from the ink tank 11 side, on a seat 15Aa formed in the atmosphere channel 17A. The cylindrical portion 21A has a cylindrical shape capable of coming in close contact with the atmosphere introduction pipe 41A so as to seal up the outer circumference of the atmosphere introduction pipe 41A. In addition, the cylindrical portion 21A has a sealing member atmosphere channel 24A for making the internal atmosphere channel 43A and the atmosphere channel 17A communicate with each other through atmosphere outlets 42A of the atmosphere introduction pipe 41A in close contact with the cylindrical portion 21A. The closing portion 25A engages with the counter boring 18Aa formed in the insertion hole 18A of the outer frame 15A, so as to close the atmosphere channel 17A.

The operation of closing and opening the atmosphere channel 17A in the joint portion 12A is substantially equivalent to the operation of closing and opening the ink channel 17 in the joint portion 12, and description thereof will be omitted. When the expansion valve 19A and the plate-like valve 20A open the atmosphere channel 17A, the atmosphere passing through the atmosphere supply tube 4A and flowing into the internal atmosphere channel 43A of the atmosphere introduction pipe 41A flows into the atmosphere channel 17A through the sealing member atmosphere channel 24A. The atmosphere flowing into the atmosphere channel 17A flows into the atmosphere guide channel 49 through the atmosphere inlet channel 13A. The atmosphere flowing into the atmosphere guide channel 49 is guided by the atmosphere guide channel 49 and supplied to an upper portion of the ink tank 11.

In the second embodiment described above, the expansion valves 19 and 19A and the plate-like valves 20 and 20A close the ink channel 17 and the atmosphere channel 17A due to the elastic forces of the expansion valves 119 and 19A and the plate-like valves 20 and 20A themselves, respectively. Accordingly, a metal elastic body such as a spring used in the background-art ink cartridge is dispensable. Further, the ink cartridge 1A is thoroughly made from synthetic resin and rubber. Thus, the user can dispose of the used ink cartridge 1A as combustible garbage.

Figure 4B:
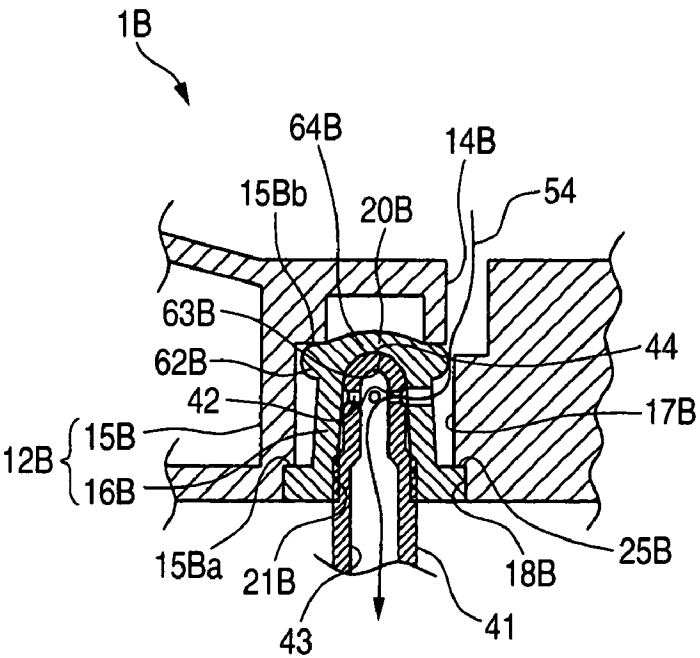
FIGS. 4A and 4B are sectional views of a joint portion of an ink cartridge according to a third embodiment.
Figure 4A:
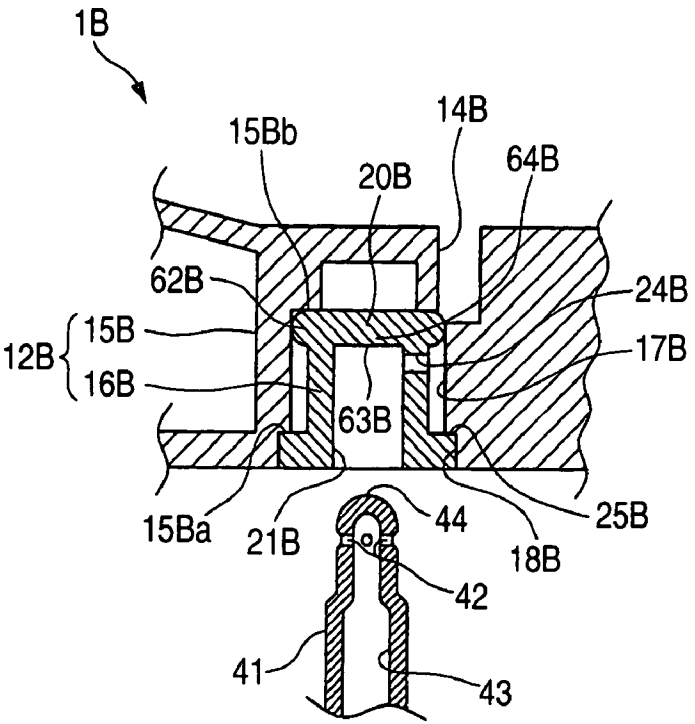

Next, an ink cartridge according to a third embodiment of the invention will be described with reference to FIGS. 4A and 4B. FIGS. 4A and 4B are sectional views of a joint portion of the ink cartridge according to the third embodiment. FIG. 4A shows the state where an ink supply pipe 41 is not connected to a joint portion 12B, and FIG. 4B shows the state where the ink supply pipe 41 has been connected to the joint portion 12B. The arrow 54 in FIG. 4B illustrates the flow of ink.

Incidentally, the ink cartridge 1B according to the third embodiment is applied to the inkjet recording apparatus 101 described in the first embodiment. In addition, the ink cartridge 1B differs from that in the first embodiment only in the joint portion 12B. Therefore, in the drawings related to the third embodiment, members the same as those in the first embodiment are denoted by the same reference numerals correspondingly, and description thereof will be omitted.

The joint portion 12B has an outer frame 15B formed out of the inner wall of the ink cartridge 1B, and a sealing member 16B disposed in the internal space of the outer frame 15B. The outer frame 15B has an ink channel 17B which is the internal space of the outer frame 15B, and an insertion hole 18B which is an opening portion of the bottom surface. That is, the ink channel 17B communicates with the ink tank 11 through an ink outlet channel 14B while communicating with the outside through the insertion hole 18B. In addition, a counter boring 15Ba for bringing the outer frame 15B and the sealing member 16B into engagement is formed in the insertion hole 18B.

The sealing member 16B is a rubber (flexible resin) member molded integrally for opening or blocking the ink channel 17B in accordance with connection or disconnection to the ink supply pipe 41 made from synthetic resin. The sealing member 16B has a plate-like valve 20B, a cylindrical portion 21B and a closing portion 25B. The plate-like valve 20B is a valve having a disc-like shape whose outer diameter is slightly larger than the inner diameter of the ink channel 17B in the horizontal direction. In addition, the vicinity of the outer edge of the plate-like valve 20B is supported, from the ink tank 11 side, on a seat 15Ba formed in the ink channel 17B. The cylindrical portion 21B has a cylindrical shape capable of coming in close contact with the ink supply pipe 41 so as to seal up the outer circumference of the ink supply pipe 41. In addition, the cylindrical portion 21B has a sealing member ink channel 24B for securing communication between the internal ink channel 43 and the ink channel 17B through the ink inlets 42 of the ink supply pipe 41 in close contact with the cylindrical portion 21B. The closing portion 25B engages with the counter boring 15Ba formed in the insertion hole 18B of the outer frame 15B, so as to close the ink channel 17B.

Next, the operation of the joint portion 12B will be described in detail. As shown in FIG. 4A, when the ink supply pipe 41 is not connected to the joint portion 12B, the plate-like valve 20B of the sealing member 16B displaces its edge (closing portion 62B) to a position (closing position) where it is in close contact with the inner wall of the ink channel 17B in the horizontal direction (a direction perpendicular to the insertion direction of the ink supply pipe 41) due to the elastic force of the plate-like valve 20B itself. Thus, the ink channel 17B is closed. As a result, there is no fear that ink reaches the sealing member ink channel 24B of the sealing member 16B.

On the other hand, when the ink supply pipe 41 is connected to the joint portion 12B as shown in FIG. 4B, the semispherical portion 44 in the front end of the inserted ink supply pipe 41 abuts against the vicinity (to-be-pressed portion 63B) of the center of the opposite surface of the plate-like valve 20B of the sealing member 16B to the ink tank 11. When the ink supply pipe 41 is further pressed, the central portion (deformation portion 64B) of the plate-like valve 20B is elastically deformed to be convex on the ink tank 11 side. When the deformation portion 64B is elastically deformed to be convex on the ink tank 11 side, the closing portion 62B of the plate-like valve 20B brought into close contact with the inner wall of the ink channel 17B in the horizontal direction due to its own elastic force is displaced to a position (separation position) where the closing portion 62B is separated from the inner wall of the ink channel 17B so as to follow the seat formed in the ink channel 17B and supporting the closing portion 62B. In this manner, the ink channel 17B is opened.

When the plate-like valve 20B opens the ink channel 17B, ink reserved in the ink tank 11 flows into the ink channel 17B through the ink outlet channel 14B. In this event, since the closing portion 25B of the sealing member 16B is in engagement with and in close contact with the counter boring 15Ba formed in the insertion hole 18B of the outer frame 15B, there is no fear that the ink flowing into the ink channel 17B leaks out from a gap between the outer frame 15B and the sealing member 16B. The ink flowing into the ink channel 17B flows into the sealing member ink channel 24B, and further flows into the internal ink channel 43 through the ink inlets 42 of the ink supply pipe 41. In this event, since the cylindrical portion 21B seals up the outer circumference of the ink supply pipe 41, there is no fear that the ink flowing into the sealing member ink channel 24B leaks out from a gap between the sealing member 16B and the ink supply pipe 41. The ink flowing into the internal ink channel 43 passes through the ink supply tube 4 and is supplied to the inkjet head 5.

In the third embodiment described above, the plate-like valve 20B closes the ink channel 17 due to the elastic force of the plate-like valve 20B itself. Accordingly, a metal elastic body such as a spring used in the background-art ink cartridge is dispensable. Further, the ink cartridge 1B is thoroughly made from synthetic resin and rubber. Thus, the user can dispose of the used ink cartridge 1 as combustible garbage. In addition, it is easy to mold the sealing member 16B because the sealing member 16B can be formed into a substantially cylindrical, simple shape as a whole.

In addition, the ink channel 17B can be opened easily with a small pressing force with which the plate-like valve 20B of the sealing member 16B is elastically deformed.

Figure 5B:
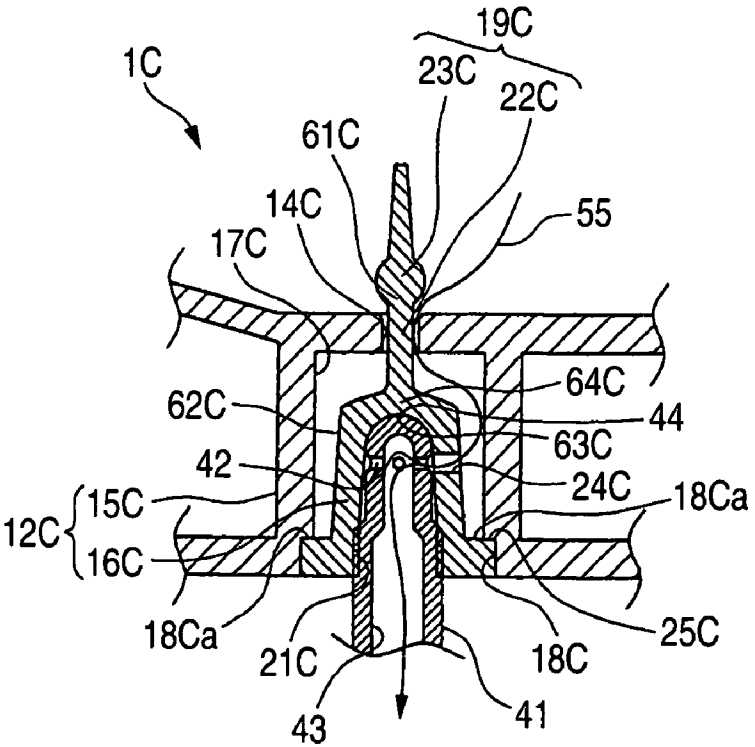
FIGS. 5A and 5B are sectional views of a joint portion of an ink cartridge according to a fourth embodiment.
Figure 5A:
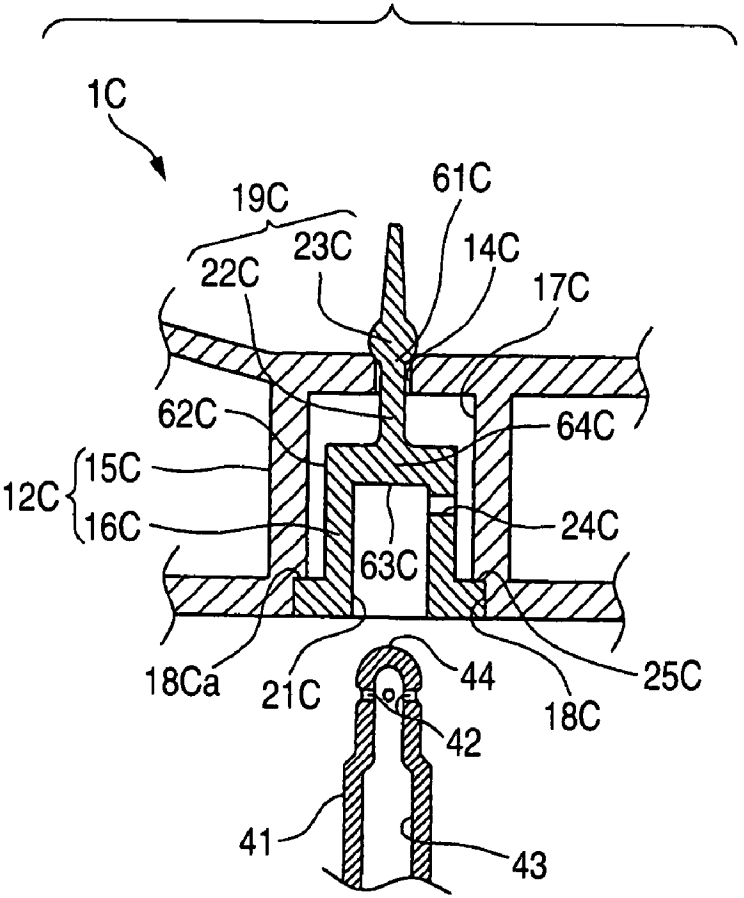

Next, an ink cartridge according to a fourth embodiment of the invention will be described with reference to FIGS. 5A and 5B. FIGS. 5A and 5B are sectional views of a joint portion of the ink cartridge according to the fourth embodiment. FIG. 5A shows the state where an ink supply pipe 41 is not connected to a joint portion 12C, and FIG. 5B shows the state where the ink supply pipe 41 has been connected to the joint portion 12C. The arrow 55 in FIG. 5B illustrates the flow of ink.

Incidentally, the ink cartridge 1C according to the fourth embodiment is applied to the inkjet recording apparatus 101 described in the first embodiment. In addition, the ink cartridge 1C differs from that in the first embodiment only in the joint portion 12C. Therefore, in the drawings related to the fourth embodiment, members the same as those in the first embodiment are denoted by the same reference numerals correspondingly, and description thereof will be omitted.

The joint portion 12C has an outer frame 15C formed out of the inner wall of the ink cartridge 1C, and a sealing member 16C disposed in the internal space of the outer frame 15C. The outer frame 15C has an ink channel 17C which is the internal space of the outer frame 15C, and an insertion hole 18C which is an opening portion of the bottom surface. That is, the ink channel 17C communicates with the ink tank 11 through an ink outlet channel 14C while communicating with the outside through the insertion hole 18C. In addition, a counter boring 18Ca for bringing the outer frame 15C and the sealing member 16C into close-contact engagement is formed in the insertion hole 18C.

The sealing member 16C is a rubber (flexible resin) member molded integrally for opening or blocking the ink channel 17C in accordance with connection or disconnection to the ink supply pipe 41C made from synthetic resin. The sealing member 16C has an expansion valve 19C, a cylindrical portion 21C and a closing portion 25C. The expansion valve 19C is a valve having an expansion portion 23C and a support portion 22C. The expansion portion 23C is larger than the outer diameter of the opening of the ink outlet channel 14C. The support portion 22C supports the expansion portion 23C. The expansion valve 19C is a valve disposed in the ink outlet channel 14C inside the ink tank 11. The support portion 22C passes through the ink outlet channel 14C and extends vertically. The cylindrical portion 21C is provided to come in close contact with the ink supply pipe 41 so as to seal up the outer circumference of the ink supply pipe 41. In addition, the cylindrical portion 21C has a sealing member ink channel 24C for securing communication between the internal ink channel 43 and the ink channel 17C through the ink inlets 42 of the ink supply pipe 41 in close contact with the cylindrical portion 21C. The closing portion 25C engages with the counter boring 18Ca formed in the insertion hole 18C of the outer frame 15C, so as to close the ink channel 17C.

Next, the operation of the joint portion 12C will be described in detail. As shown in FIG. 5A, when the ink supply pipe 41 is not connected to the joint portion 12C, the lower surface (closing portion 61C) of the expansion valve 19C of the sealing member 16C is displaced to a position (closing position) where it is pulled into the ink channel 17C due to the elastic force of the support portion 22C, so as to close the opening portion of the ink outlet channel 14C on the ink tank 11 side. Thus, the ink channel 17C is closed so that there is no fear that ink reaches the sealing member ink channel 24C of the sealing member 16C.

On the other hand, when the ink supply pipe 41 is connected to the joint portion 12C as shown in FIG. 5B, the semispherical portion 44 in the front end of the inserted ink supply pipe 41 abuts against the vicinity (to-be-pressed portion 63C) of the center of the opposite surface to the ink tank 11 in a plate-like portion further supporting the support portion 22C of the expansion valve 19C. When the ink supply pipe 41 is further pressed, the central portion (deformation portion 64C) of the plate-like portion is elastically deformed to be convex on the ink tank 11 side. When the deformation portion 64C is elastically deformed to be convex on the ink tank 11 side, the support portion 22C is pushed upon the ink tank 11 side. When the support portion 22C is pushed up, the closing portion 61C of the expansion valve 19C supported by the support portion 22C and closing the opening portion of the ink outlet channel 14C on the ink tank 11 side is displaced to a position (separation position) where the closing portion 61C is also pushed up. Thus, the opening of the ink outlet channel 14C on the ink tank 11 side is opened. In such a manner, the ink channel 17C is opened.

When the expansion valve 19C opens the ink channel 17C, ink reserved in the ink tank 11 flows into the ink channel 17C through the ink outlet channel 14C. In this event, since the closing portion 25C of the sealing member 16C is in engagement with and in close contact with the counter boring 18Ca formed in the insertion hole 18C of the outer frame 15C, there is no fear that the ink flowing into the ink channel 17C leaks out from a gap between the outer frame 15C and the sealing member 16C. The ink flowing into the ink channel 17C flows into the sealing member ink channel 24C, and further flows into the internal ink channel 43 through the ink inlets 42 of the ink supply pipe 41. In this event, since the cylindrical portion 21C seals up the outer circumference of the ink supply pipe 41, there is no fear that the ink flowing into the sealing member ink channel 24C leaks out from a gap between the sealing member 16C and the ink supply pipe 41. The ink flowing into the internal ink channel 43 passes through the ink supply tube 4 and is supplied to the inkjet head 5.

In the fourth embodiment described above, the expansion valve 19C closes the ink channel 17C due to the elastic force of the expansion valve 19C itself. Accordingly, a metal elastic body such as a spring used in the background-art ink cartridge is dispensable. Further, the ink cartridge 1C is thoroughly made from synthetic resin and rubber. Thus, the user can dispose of the used ink cartridge 1C as combustible garbage.

In addition, the durability of the expansion valve 19C can be improved because the deformation of the expansion valve 19C is low when it opens the ink channel 17C.

In addition, in the same manner as in the aforementioned first embodiment, the ink outlet channel 14C is closed from the inside of the ink tank 11 by the expansion valve 19C disposed inside the ink tank 11. Due to this configuration, an ink leakage preventing mechanism strong against changes in the environment can be achieved in the same manner as in the first embodiment.

Figure 6B:
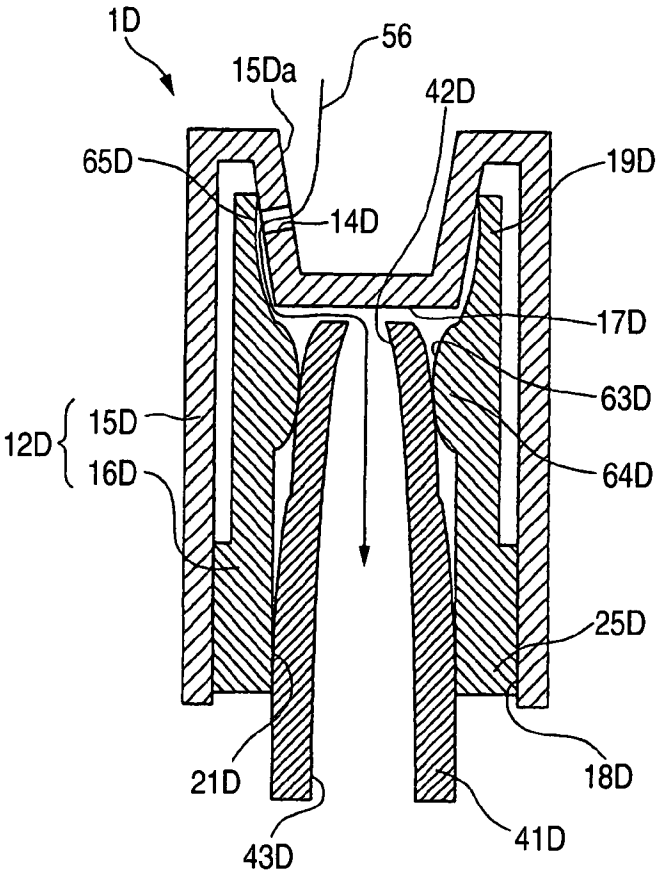
FIGS. 6A and 6B are sectional views of a joint portion of an ink cartridge according to a fifth embodiment.
Figure 6A:
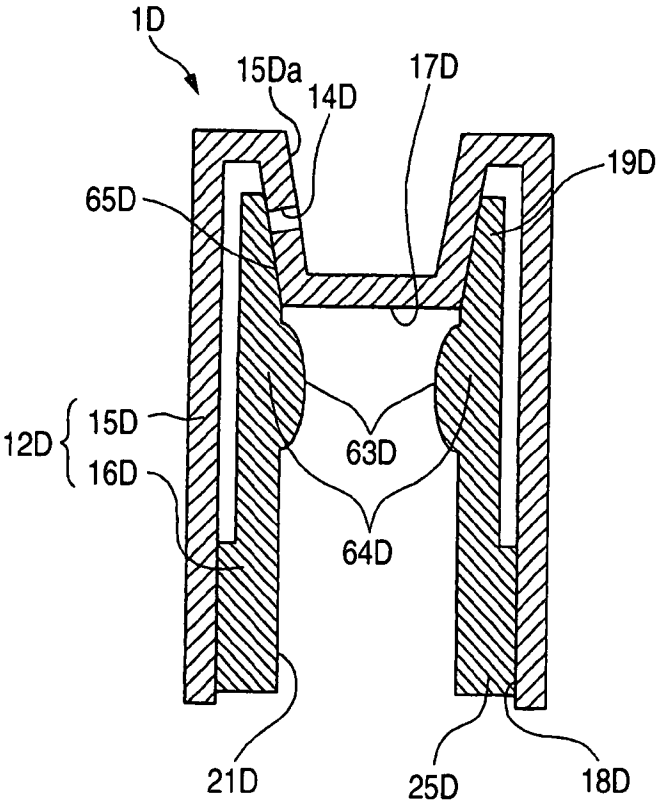

Next, an ink cartridge according to a fifth embodiment of the invention will be described with reference to FIGS. 6A and 6B. FIGS. 6A and 6B are sectional views of a joint portion of the ink cartridge according to the fifth embodiment. FIG. 6A shows the state where an ink supply pipe 41D is not connected to a joint portion 12D, and FIG. 6B shows the state where the ink supply pipe 41D has been connected to the joint portion 12D. The arrow 56 in FIG. 6B illustrates the flow of ink.

Incidentally, the ink cartridge 1D according to the fifth embodiment is applied to the inkjet recording apparatus 101 described in the first embodiment. In addition, the ink cartridge 1D differs from that in the first embodiment only in the joint portion 12D. Therefore, in the drawings related to the fifth embodiment, members the same as those in the first embodiment are denoted by the same reference numerals correspondingly, and description thereof will be omitted.

An ink supply pipe 41D made from synthetic resin is a cylindrical pipe to be connected to the ink cartridge 1D. The ink supply pipe 41D has an ink inlet 42D and an internal ink channel 43D. The ink inlet 42D is an opening portion formed at the front end of the ink supply pipe 41D. The internal ink channel 43D communicates with the outside through the ink inlet 42D. The ink supply pipe 41D has a shape tapered gradually toward its front end.

The joint portion 12D has an outer frame 15D formed out of the inner wall of the ink cartridge 1D, and a sealing member 16D disposed in the internal space of the outer frame 15D. The outer frame 15D has an ink channel 17D which is the internal space of the outer frame 15D, and an insertion hole 18D which is an opening portion of the bottom surface. That is, the ink channel 17D communicates with the ink tank 11 through an ink outlet channel 14D while communicating with the outside through the insertion hole 18D. In addition, a protrusion portion 15Da having a closed-end cylindrical shape which is convex on the ink channel 17D side is formed in the inner wall of the outer frame 15D on the ink tank 11 side. The ink outlet channel 14D is formed to penetrate the outer circumferential surface of the protrusion portion 15Da.

The sealing member 16D is a rubber (flexible resin) member molded integrally for opening or blocking the ink channel 17D in accordance with connection or disconnection to the ink supply pipe 41D. The sealing member 16D has a cylindrical valve 19D, a cylindrical portion 21D and a closing portion 25D. The cylindrical valve 19D is a valve having a cylindrical shape tapered toward the ink tank 11 side and having an inner circumferential surface to be brought into close contact with the outer circumferential surface of the protrusion portion 15Da of the outer frame 15D. The cylindrical portion 21D is provided to come in close contact with the outer circumferential surface of the ink supply pipe 41D so as to seal up the outer circumference of the ink supply pipe 41D. The cylindrical portion 21D forms a cylindrical shape contiguous to the cylindrical valve 19D. In the border region with the cylindrical valve 19D, a bulging portion is formed in the inner side surface to be engaged with the ink supply pipe 41D. The closing portion 25D is bonded with the insertion hole 18D of the outer frame 15D by an adhesive agent, so as to close the ink channel 17D.

Next, the operation of the joint portion 12D will be described in detail. As shown in FIG. 6A, when the ink supply pipe 41D is not connected to the joint portion 12D, the inner side (closed portion 65D) of the cylindrical valve 19D of the sealing member 16D is displaced to a position (closing position) where it is pressed onto the outer circumference of the protrusion portion 15Da of the outer frame 15D due to the elastic force of the cylindrical valve 19D itself, so as to close the ink outlet channel 14D. As a result, there is no fear that ink reaches the ink channel 17D.

On the other hand, when the ink supply pipe 41D is connected to the joint portion 12D as shown in FIG. 6B, a side wall portion in the vicinity of the front end of the inserted ink supply pipe 41D abuts against the bulging portion (to-be-pressed portion 63D) formed in the cylindrical portion 21D of the sealing member 16D. When the ink supply pipe 41D is further pressed in its insertion direction, the outer circumferential surface of the ink supply pipe 41D pushes the to-be-pressed portion 63D open. Thus, the cylindrical valve 19D (deformation portion 64D) is elastically deformed to be displaced to a position (separation position) where it opens the closing portion 65D. As a result, the ink outlet channel 14D is opened so that the ink channel 17D communicating therewith is opened.

When the cylindrical valve 19D opens the ink channel 17D, ink reserved in the ink tank 11 flows into the ink channel 17D through the ink outlet channel 14D. The ink flowing into the ink channel 17D flows into the internal ink channel 43D through the ink inlet 42D of the ink supply pipe 41D. In this event, since the cylindrical portion 21D seals up the outer circumference of the ink supply pipe 41D, there is no fear that the ink flowing into the ink channel 17D leaks out from a gap between the sealing member 16D and the ink supply pipe 41D. The ink flowing into the internal ink channel 43D passes through the ink supply tube 4 and is supplied to the inkjet head 5.

In the fifth embodiment described above, the cylindrical valve 19D closes the ink channel 17D due to the elastic force of the cylindrical valve 19D itself. Accordingly, a metal elastic body such as a spring used in the background-art ink cartridge is dispensable. Further, the ink cartridge 1D is thoroughly made from synthetic resin and rubber. Thus, the user can dispose of the used ink cartridge 1D as combustible garbage.

In addition, the manufacturing cost of the ink cartridge can be reduced due to the simple structures of the outer frame 15D and the cylindrical valve 19D.

Moreover, since the closing portion 25D is bonded with the insertion hole 18D of the outer frame 15D by an adhesive agent, it is possible to connect the outer frame 15D and the sealing member 16D surely.

Figure 7B:
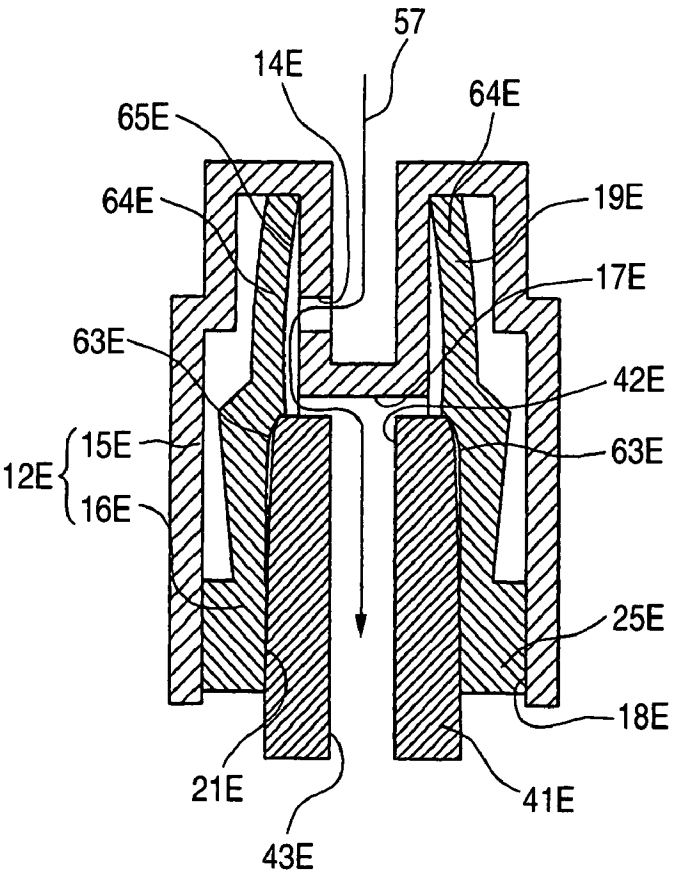
FIGS. 7A and 7B are sectional views of a modification of the joint portion of the ink cartridge according to the fifth embodiment.
Figure 7A:
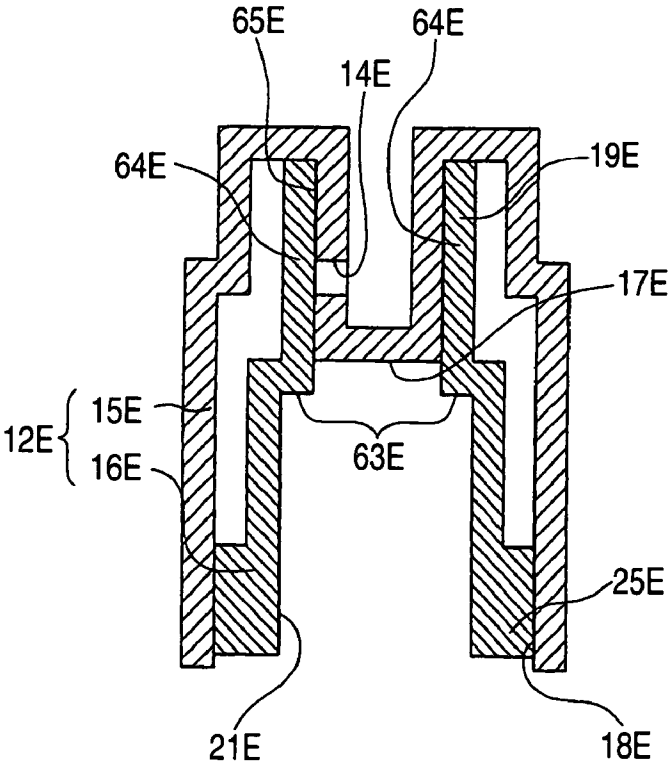

In the fifth embodiment, the cylindrical portion 21D forms a cylindrical shape contiguous to the cylindrical valve 19D, and in the border region with the cylindrical valve 19D, a bulging portion formed in the inner side surface in contact with the ink supply pipe 41D serves as the to-be-pressed portion 63D. However, the invention is not limited to such a configuration. For example, as shown in FIG. 7A, the inner diameter of a cylindrical valve 19E may be made narrower than the inner diameter of a cylindrical portion 21E, while an end portion of the cylindrical valve 19E on the cylindrical portion 21E side is formed as a to-be-pressed portion 63E. In this configuration, as shown in FIG. 7B, when an ink supply pipe 41E made from synthetic resin is connected to a joint portion 12E, the front end portion of the inserted ink supply pipe 41E abuts against the to-be-pressed portion 63E of the sealing member 16E. When the ink supply pipe 41E is further pressed, the cylindrical valve 19E (deformation portion 64E) is elastically deformed to be convex on the outside. When the deformation portion 64E is elastically deformed to be convex on the outside, an ink outlet channel 14E is opened so that the ink channel 17E communicating therewith is opened. In this case, the ink supply pipe 41E does not have to have a tapered shape.

When the cylindrical valve 19E opens the ink channel 17E, ink reserved in the ink tank 11 flows into the ink channel 17E through the ink outlet channel 14E. The ink flowing into the ink channel 17E flows into an internal ink channel 43E through an ink inlet 42E of the ink supply pipe 41E. The ink flowing into the internal ink channel 43E passes through the ink supply tube 4 and is supplied to the inkjet head 5 (the arrow 57).

Although the preferred embodiments of the invention have been described above, the invention is not limited to the embodiments, but various changes on design can be made within the scope stated in claims. For example, the sealing members 16 and 16A-16E are rubber members molded integrally in the first to fifth embodiments. However, the invention is not limited to such configurations. A sealing member may be formed out of rubber members molded separately. Alternatively, a sealing member may be molded out of flexible resin other than rubber.

Although the sealing member 16, 16A-16E presses a to-be-pressed portion in the first to fifth embodiments, the sealing member may press the to-be-pressed portion through another member.

Although the sealing member 16, 16A-16E has a valve mechanism using the expansion valve 19, 19A, 19C, the plate-like valve 20, 20A, 20B and the cylindrical valve 19D, 19E in the first to fifth embodiments, the invention is not limited to such a configuration. Another valve mechanism may be arranged if it is formed out of combustible elastic materials other than metal.

In the first to fourth embodiments, the outer frame 15, 15A-15C and the sealing member 16, 16A-16C are connected with each other due to engagement between the closing portion 25, 25A-25C and the outer frame 15, 15A-15C. In the fifth embodiment, the closing portion 25D and the outer frame 15D are bonded with each other by an adhesive agent so as to connect the outer frame 15D and the sealing member 16D. However, the invention is not limited to such configurations. To connect the both, they may be engaged with each other while being bonded by an adhesive agent.

In the aforementioned first to fifth embodiments, all the constituent members of the ink cartridge 1, 1A-1D are formed out of combustible materials (rubber or synthetic resin) so that the user can dispose of the used cartridge as combustible garbage without disassembling the cartridge. However, some local governments handle rubber or the like as incombustible garbage. The sealing member 16, 16A-16D should be removed and separated from the ink cartridge 1, 1A-1D when the ink cartridge 1, 1A-1D is disposed of in such a local government.

According to the embodiments, the sealing member 16, 16A-16E is molded integrally. With this configuration, the number of parts serving as the sealing member is one. Thus, the manufacturing cost of the ink cartridge can be reduced.

According to the embodiments, the outer frame 15, 15A-15E is made from resin, and the sealing member 16, 16A-16E is made from flexible resin. With this configuration, the outer frame and the sealing member are formed out of resin. Thus, it becomes easier for the user to dispose of the ink cartridge as combustible garbage when it has been used up.

According to the embodiments, the valve portion has a to-be-pressed portion 63, 63B, 63C to be pressed onto a front end of the ink supply pipe when the ink supply pipe is inserted, a deformation portion 64, 64B, 64C to be deformed when the to-be-pressed portion is pressed, and a closing portion 62, 62B, 62C to be brought into close contact with the outer frame to thereby close the ink channel; and the closing portion can be displaced between a closing position where the closing portion is brought into close contact with the outer frame in accordance with a shape of the deformation portion, and a separation position where the closing portion leaves the outer frame. With this configuration, the ink channel can be opened only by pressing the ink supply pipe in an insertion direction thereof.

According to the embodiments, a plate-like portion 20, 20B extending in a direction perpendicular to an insertion direction of the ink supply pipe is formed in the valve portion of the sealing member; and an outer edge of the plate-like portion of the valve portion is brought into close contact with an inner wall of the outer frame due to elastic force to thereby close the ink channel when the ink supply pipe is not inserted into the cylindrical portion, while the plate-like portion of the valve portion is elastically deformed to allow the outer edge of the plate-like portion leave the inner wall of the outer frame to thereby open the ink channel when the ink supply pipe is inserted into the cylindrical portion. With this configuration, the ink channel can be opened by elastically deforming the valve portion easily with a small pressing force.

According to the embodiments, an opening 14, 14C for forming the ink channel is provided in an ink-tank-side end portion of the outer frame; an expansion portion 23, 23C urged due to deformation of the sealing member itself in a direction to close the opening and having a larger diameter than a diameter of the opening is formed in the valve portion of the sealing member; and the expansion portion of the valve portion closes the opening due to urging force applied thereto so as to close the ink channel when the ink supply pipe is not inserted into the cylindrical portion, while the expansion portion of the valve portion leaves the opening against the urging force so as to open the ink channel when the ink supply pipe is inserted into the cylindrical portion. With this configuration, the valve portion is less deformed when the ink channel is open. Thus, the durability of the valve portion can be improved.

Particularly, according to the first embodiment, an opening 14 for forming the ink channel is provided in an ink-tank-side end portion of the outer frame; a plate-like portion 20 extending in a direction perpendicular to an insertion direction of the ink supply pipe, and an expansion portion 23 urged due to deformation of the sealing member itself in a direction to close the opening and having a larger diameter than a diameter of the opening are formed in the valve portion of the sealing member; and an outer edge of the plate-like portion of the valve portion is brought into close contact with an inner wall of the outer frame due to elastic force and the expansion portion of the valve portion closes the opening due to urging force applied thereto, so as to close the ink channel, when the ink supply pipe is not inserted into the cylindrical portion, while the plate-like portion of the valve portion is elastically deformed to allow the outer edge of the plate-like portion to leave the inner wall of the outer frame and the expansion portion of the valve portion leaves the opening against the urging force, so as to open the ink channel, when the ink supply pipe is inserted into the cylindrical portion. With this configuration, the ink channel can be closed doubly by the plate-like portion and the expansion portion. Thus, the ink channel can be closed surely.

According to the fifth embodiment, a cylindrical deformation portion 19D connected to the cylindrical portion 21D is formed in the valve portion of the sealing member, while an opening 14D for forming the ink channel is formed in the outer frame, and a region opposed to the cylindrical deformation portion of the valve portion is provided in the outer frame; and the cylindrical deformation portion of the valve portion closes the opening due to elastic force so as to close the ink channel when the ink supply pipe is not inserted into the cylindrical portion, while the cylindrical deformation portion of the valve portion is elastically deformed to leave the opening so as to open the ink channel when the ink supply pipe is inserted into the cylindrical portion. With this configuration, the structures of the outer frame and the sealing member are made so simple that the manufacturing cost of the ink cartridge can be reduced.

According to the fifth embodiment, at least a part of the sealing member is fixed to the outer frame by an adhesive agent. With this configuration, the outer frame and the sealing member can be connected surely.

Alternatively, according to the first to fourth embodiments, at least a part of the sealing member is fixed to the outer frame by engagement therewith. With this configuration, the outer frame and the sealing member can be connected easily by engagement. Thus, the manufacturing cost of the ink cartridge can be reduced.

According to the embodiments, all of constituent members of the ink cartridge including the sealing member are made from combustible materials. With this configuration, not only is it possible to arrange the joint without using any metal material, but it is possible to arrange other constituent parts of the ink cartridge using not any metal material but combustible materials. Thus, when the ink cartridge has been used up, the user can dispose of the ink cartridge as combustible garbage without requiring working such as disassembling.

Figure 8:
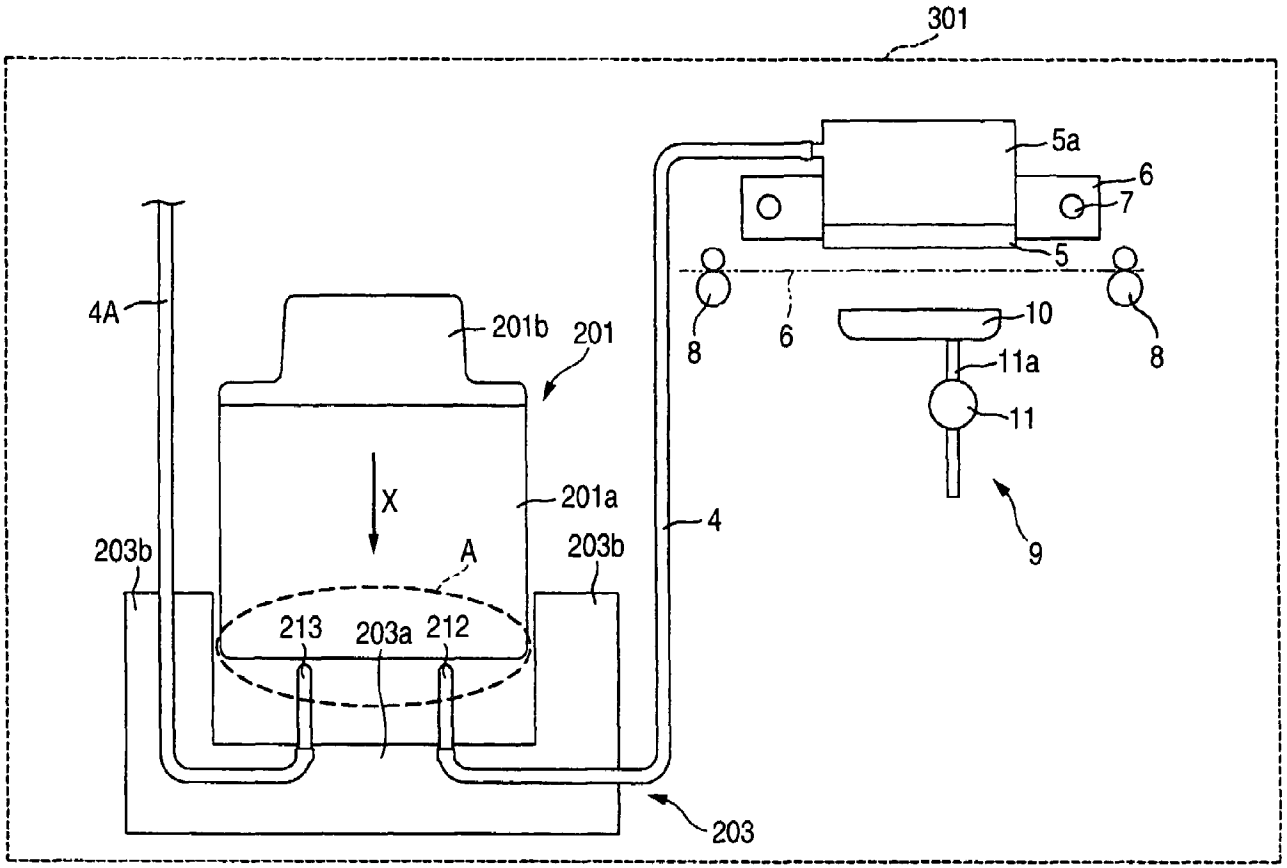
FIG. 8 is a schematic view showing an ink cartridge according to a sixth embodiment of the invention, and an inkjet recording apparatus mounted with the ink cartridge.

A sixth embodiment of the invention will be described below with reference to FIGS. 8 toll. FIG. 8 is a schematic view showing an ink cartridge 201 according to the embodiment of the invention, and inkjet recording apparatus 301 to be mounted with the ink cartridge 201.

The ink cartridge 201 is designed to be removably attached to the inkjet recording apparatus 301 having an inkjet head 5 for ejecting ink. The ink cartridge 201 is to reserve ink to be supplied to the inkjet head 5.

The ink cartridge 201 has a body casing 201*a* shaped like a hollow box open on its top, and a cover 201*b* for sealing the open top of the body casing 201*a*. The ink to be supplied to the inkjet head 5 is reserved in an ink chamber 216 (see FIG. 9) formed inside the body casing 1*a*. Incidentally, a plurality of ink cartridges filled with inks of four colors, that is, cyan, magenta, yellow and black respectively, are attached to the inkjet recording apparatus 301.

The inkjet recording apparatus 301 has mounting portions 203, tanks 5*a*, recording heads 5, a carriage 6, carriage shafts 7, conveyance mechanisms 8 and a purging unit 9. Each ink cartridge 201 is removably attached to the corresponding mounting portion 3. Each tank 5*a* reserves ink to be supplied from the corresponding ink cartridge 201 through an ink supply tube 4. Ink reserved in the tank 5*a* is ejected onto recording paper P by the corresponding inkjet head 5. The carriage 6 mounted with the tanks 5*a* and the recording heads 5 reciprocates in a straight line direction. The carriage shafts 7 serve as guides with which the carriage 6 reciprocates. The conveyance mechanisms 8 convey the recording paper P.

Each mounting portion 203 is constituted by a base portion 203*a* and guide portions 203*b* provided erectly on opposite sides of the base portion 203*a*. A hollow ink supply pipe 212 for extracting ink reserved in the ink cartridge 201 and a hollow outside-air introduction pipe 213 for introducing the outside air into the ink cartridge 201 are disposed to project from the base portion 203*a* put between the guide portions 203*b*.

The ink supply tube 4 is connected to one end of the ink supply pipe 212 so that the ink supply pipe 212 communicates with the tank 5*a* through the ink supply tube 4. An outside-air introduction tube 4A is connected to one end of the outside-air introduction pipe 213 so that the outside-air introduction pipe 213 communicates with the outside through the outside-air introduction tube 4A.

The ink cartridge 201 is mounted on the mounting portion 203 in the vertical direction (arrow x direction). In this event, the ink supply pipe 212 and the outside-air introduction pipe 213 deform a sealing member 231 and a sealing member 251 both provided inside the ink cartridge 201 so as to communicate with the inside of the ink chamber 216 respectively. Incidentally, the projecting front end portions of the ink supply pipe 212 and the outside-air introduction pipe 213 are rounded to prevent intermediate walls 231*b* and 251*b* from deteriorating due to the front end portions when they abut against the intermediate walls 231*b* and 251*b* respectively.

An opening 212*b* is formed in a side surface of the ink supply pipe 212 perpendicular to the central axis direction of an internal channel 212*a* so that ink is supplied to the ink-jet head 5 through the internal channel 212*a* communicating with the opening 212*b*. In the same manner, an opening 213*b* is formed in a side surface of the outside-air introduction pipe 213 so that the outside air is introduced into the ink chamber 216 through an internal channel 213*a* communicating with the opening 213*b* (see FIG. 11).

In the inkjet head 5, a plurality of nozzle holes are provided in a surface opposed to the recording paper P. By driving actuators made of piezoelectric elements, ink reserved in the tank 5*a* is ejected from the nozzle holes toward the recording paper P. Incidentally, in an actual recording operation, recording is performed on the recording paper P while the carriage 6 mounted with the inkjet head 5 reciprocates.

The inkjet head 5 is disposed above the mounting portion 203 so that negative pressure (back pressure) is applied to ink in each nozzle hole due to a difference in water-head between the ink cartridge 201 mounted on the mounting portion 203 and the nozzle hole.

The purging unit 9 is disposed outside a recording range so as to be opposed to the inkjet head 5. The purging unit 9 has a purging cap 10, a waste ink tube 11*a* and a pump 11. The purging cap 10 covers the nozzle hole formation surface of the inkjet head 5. The waste ink tube 11*a* communicates with the purging cap 10. The pump 11 sucks ink from the nozzle holes through the waste ink tube 11*a*.

For carrying out a purging process, the carriage 6 is moved to a purging process execution position, and the nozzle hole formation surface of the inkjet head 5 is covered with the purging cap 10. In this state, the pump 11 is driven to suck defective ink staying inside the inkjet head 5 and containing bubbles or the like. The sucked defective ink is reserved in a not-shown waste ink tank through the waste ink tube 11*a*. Incidentally, the recording operation or the purging process is controlled by a CPU (not shown) serving as a central processing unit mounted on the inkjet recording apparatus 301.

Figure 9:
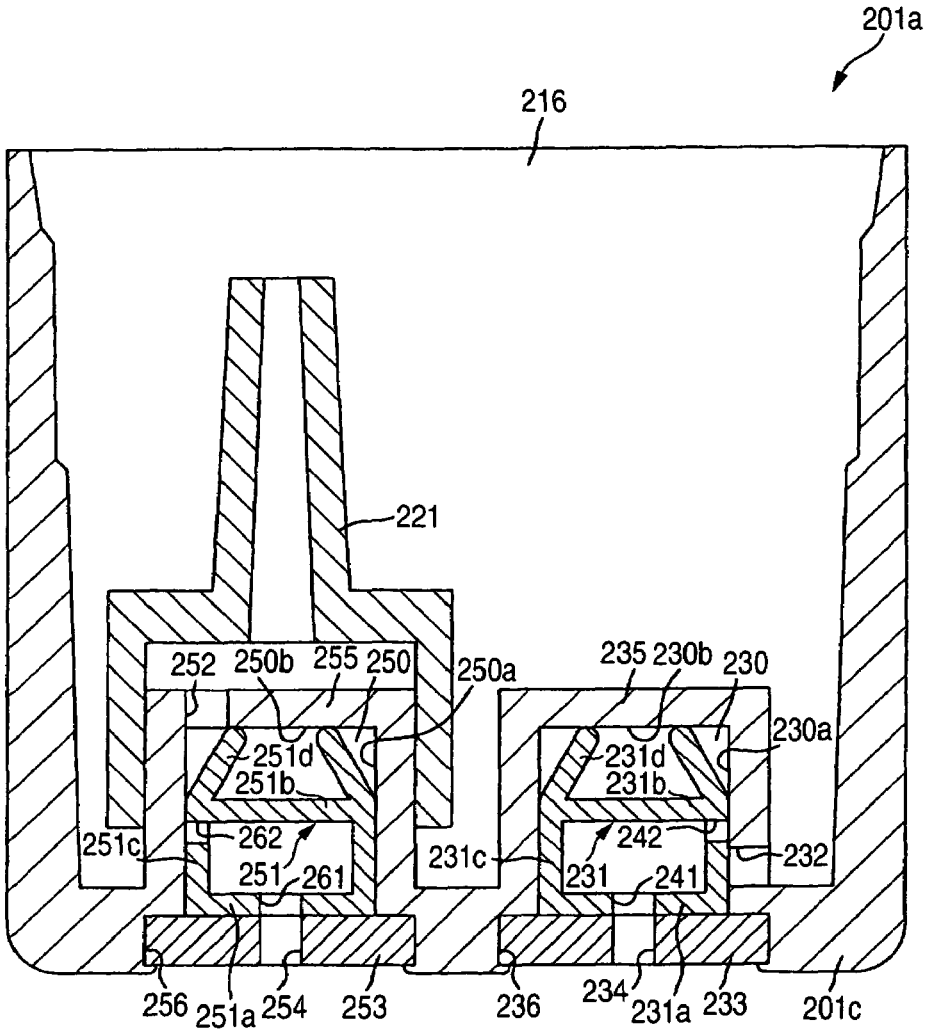
FIG. 9 is a sectional view of a joint portion in which the ink cartridge has not yet been attached to the inkjet recording apparatus.

Next, with reference to FIG. 9, description will be made about the configuration of a joint portion (the portion A in FIG. 1) of the ink cartridge 201 to the inkjet recording apparatus 301. FIG. 9 is a sectional view of the joint portion before the ink cartridge 201 is attached to the inkjet recording apparatus 301.

The body casing 201*a* has an opening 236 and an opening 256 in a bottom wall 201*c*. The opening 236 is located in a position corresponding to the ink supply pipe 212, and the opening 256 is located in a position corresponding to the outside-air introduction pipe 213. An ink supply chamber 230 and an outside-air introduction chamber 250 are formed correspondingly to the openings so as to communicate therewith respectively.

The ink supply chamber 230 is partitioned off in the ink chamber 216 by a partition wall 235 rising from the bottom wall 201*c* integrally therewith in the ink chamber 216. The opening 236 side of the ink supply chamber 230 is closed by a cover member 233. The ink supply chamber 230 is defined by an inner wall surface 230*a* parallel to the central axis perpendicular to a plane parallel to the opening 26, and two end surfaces 230*b* located in the opposite ends in the direction of the axis. One of the end surfaces 230*b* is comprised of the upper surface of the cover member 233. The cover member 233 has an insertion hole 234 for inserting the ink supply pipe 212 thereto in the direction of the central axis. A seal member (not shown) brought into contact with the ink supply pipe 212 so as to seal the ink supply pipe 212 is provided in the inner surface of the insertion hole 234. In the partition wall 235, a first communication hole 232 is formed to allow the ink supply chamber 230 and the ink chamber 216 to communicate with each other. Preferably, the first communication hole 232 is formed in a connecting portion between the side surface of the partition wall 235 corresponding to the inner wall surface 230*a*, and the bottom wall 201*c*.

The outside-air introduction chamber 250 is partitioned off in the ink chamber 216 by a partition wall 255 rising from the bottom wall 201*c* integrally therewith in the ink chamber 216. The opening 256 side of the outside-air introduction chamber 250 is closed by a cover member 253. The outside-air introduction chamber 250 is defined by an inner wall surface 250*a* parallel to the central axis perpendicular to a plane parallel to the opening 256, and two end surfaces 250*b* located in the opposite ends in the direction of the axis. One of the end surfaces 250*b* is comprised of the upper surface of the cover member 253. The cover member 253 has an insertion hole 254 for inserting the outside-air introduction pipe 213 thereto in the direction of the central axis. A seal member (not shown) brought into contact with the outside-air introduction pipe 213 so as to seal the outside-air introduction pipe 213 is provided in the inner surface of the insertion hole 254. The ink supply chamber 230 and the outside-air introduction chamber 250 are formed to have the same dimensions so that compatible parts can be used for the cover members 233 and 253.

A cylindrical outside-air guide member 221 is fitted and connected to the outer circumference of the partition wall 255. An outside-air communication hole 252 is formed in the top wall of the partition wall 255 opposed to the inside of the outside-air guide member 221. When the outside-air introduction pipe 213 is inserted and connected into the outside-air introduction chamber 250 as will described later, the outside air from the outside-air introduction pipe 213 is guided to the upper space of the ink chamber 216.

Figure 10:
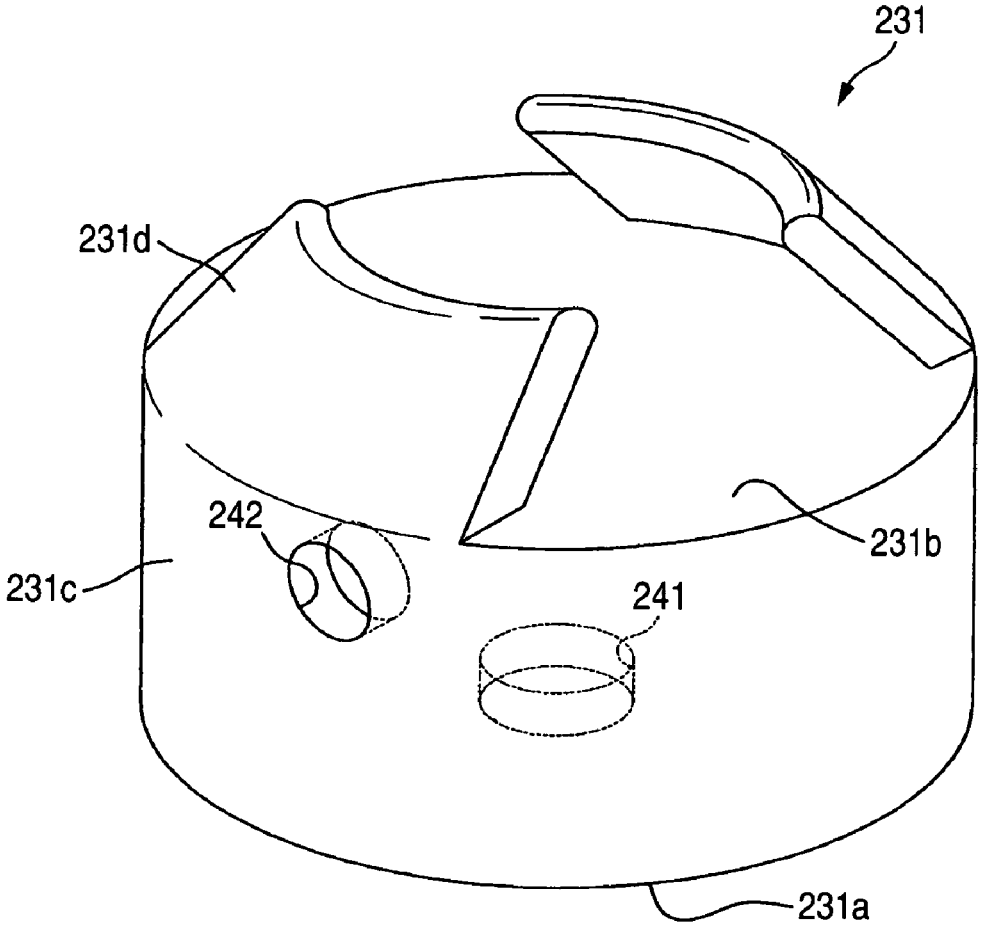
FIG. 10 is a perspective view showing the structure of a sealing member.

Now, the structure of the sealing member 231 will be described in detail with reference to FIG. 10. FIG. 10 is a perspective view showing the structure of the sealing member 231. Incidentally, the sealing member 251 is formed to have the same shape as that of the sealing member 231, and detailed description thereof will be omitted.

The sealing member 231 is comprised of an outer circumferential wall 231*c*, an intermediate wall 231*b* and a bottom wall 231*a*. The outer circumferential wall 231*c* has a length extending almost all over the length of the ink supply chamber 230 in its central axis direction. The intermediate wall 231*b* is located in the intermediate position between the opposite ends of the outer circumferential wall 231*c* so as to divide the inside of the outer circumferential wall 231*c* into two parts. The bottom wall 231*a* extends to bridge one end portion of the outer circumferential wall 231*c*. The sealing member 231 is made from an elastic material like rubber. Of the outer circumferential wall 231*c*, a part on the bottom wall 231*a* side with respect to the intermediate wall 231*b* is formed into a cylindrical shape in close contact with the inner wall surface of the ink supply chamber 230. The intermediate wall 231*b* extends in a direction perpendicular to the direction of the aforementioned central axis so as to be connected to the outer circumferential wall 231*c*. In the aforementioned part of the outer circumferential wall 231*c*, a second communication hole 242 penetrating the outer circumferential wall 231*c* is formed in a position where the second communication hole 242 is not opposed to the first communication hole 232. In the bottom wall 231*a*, an insertion hole 241 allowing the ink supply pipe 212 to be inserted thereto is formed correspondingly to the insertion hole 234.

In the outer circumferential wall 231*c*, a part 231*d* extending from the intermediate wall 231*b* on the opposite side to the bottom wall 231*a* is formed to be inclined inward with respect to the extended plane of the aforementioned part on the bottom wall 231*a* side. The front end of the part 231*d* is formed as a free end.

The sealing member 231 is pressed into the ink supply chamber 230, and the cover member 233 is fixedly attached to the bottom wall 201*c*. Thus, the sealing member 231 is retained. In this state, the front end of the inclined part 231*d* of the outer circumferential wall abuts against the upper end surface 230*b* of the ink supply chamber 230, and the bottom wall 231*a* abuts against the cover member 233. Thus, the sealing member 231 is positioned axially. In addition, the outer circumferential wall 231*c* between the intermediate wall 231*b* and the bottom wall 231*a* is brought into close contact with the inner wall surface 230*a* of the ink supply chamber 230 by elastic force. Thus, the first communication hole 232 is closed by the outer circumferential wall 231*c*, and the second communication hole 242 is closed by the inner wall surface 230*a*.

The sealing member 251 to be disposed in the outside-air communication chamber 250 has an outer circumferential wall 251*c*, an intermediate wall 251*b*, a bottom wall 251*a* and an inclined part 251*d* in the same manner as the sealing member 231 so that compatible parts can be used for the sealing members 231 and 251.

Figure 11:
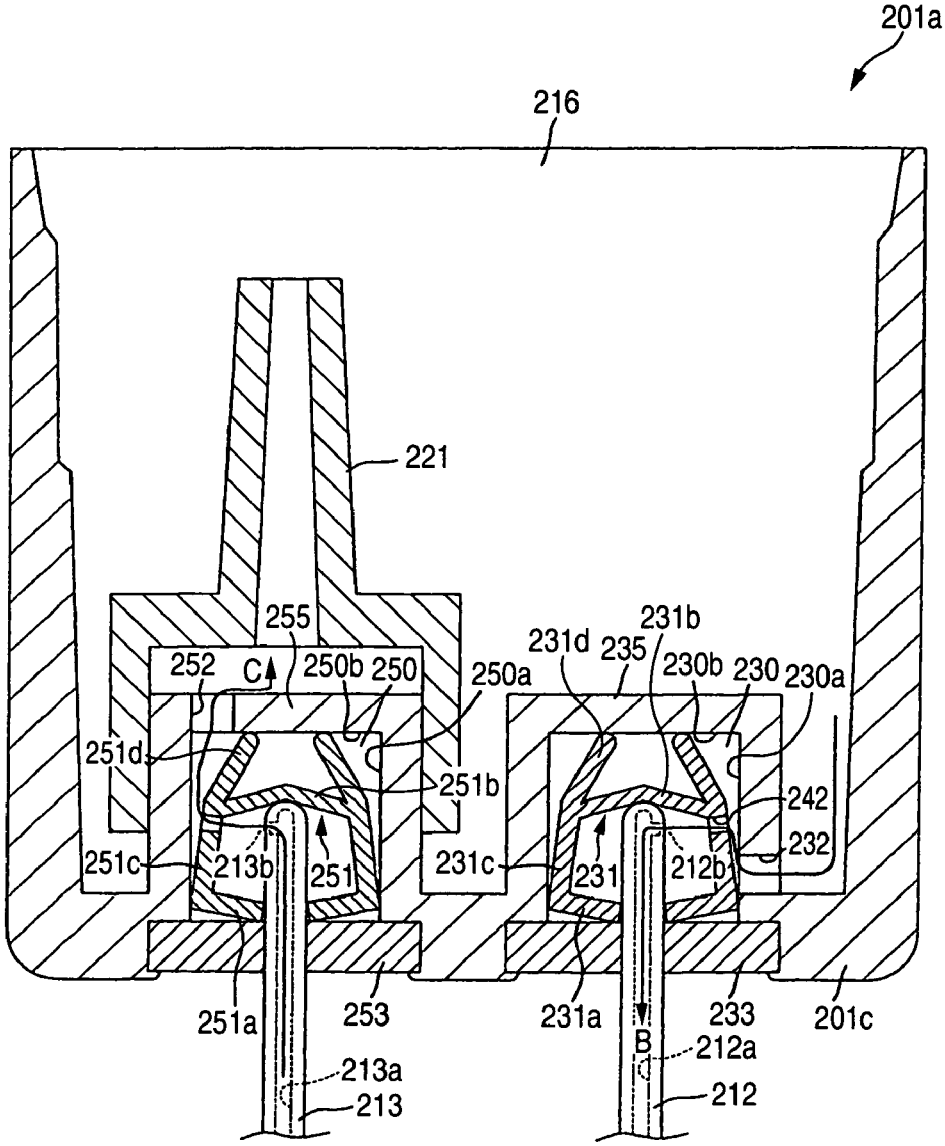
FIG. 11 is a sectional view of the joint portion in which the ink cartridge has been attached to the inkjet recording apparatus.

Next, with reference to FIG. 11, description will be made about the operations of the sealing members 231 and 251 when the ink cartridge 1 is attached to the inkjet recording apparatus 301. FIG. 11 is a sectional view of a joint portion showing the state where the ink cartridge 201 has been attached to the ink-jet recording apparatus 301.

When the ink cartridge 1 is mounted on the mounting portion 203, the ink supply pipe 212 invades the inside of the sealing member 231 through the insertion hole 234 and the insertion hole 241. Further, with the advance of insertion of the ink cartridge 201, the rounded front end of the ink supply pipe 212 pushes substantially the center of the intermediate wall 231*b* so that the intermediate wall 231*b* is bent and deformed like a mountain in the aforementioned axial direction with the pushed point as a vertex. Then, the outer diameter of the outer circumferential wall 231*c* directly corresponding to the outer circumferential portion of the intermediate wall 231*b* is reduced so that the outer circumferential wall 231*c* leaves the inner wall surface 230*a* of the ink supply chamber 230. At the same time, the inclined wall 231*d* suffers an axial force to thereby allow its free end to slide on the end surface 230*b*. Thus, the inclined wall 231*d* is further inclined inward so that the outer circumferential wall 231*c* leaves the inner wall surface 230*a* more largely.

Accordingly, the first communication hole 232 and the second communication hole 242 are opened to secure communication between the first communication hole 232 and the second communication hole 242. Then, a channel B running from the inside of the ink chamber 216 to the internal channel 212*a* of the ink supply pipe 212 through the ink supply chamber 230 and the inside of the sealing member 231 is formed so as to supply ink to the inkjet head 5.

When the outside-air introduction pipe 213 is inserted into the sealing member 251, the sealing member 251 is deformed in the same manner as the sealing member 231. The outside air supplied from the outside-air introduction pipe 213 is introduced into the upper space of the ink chamber 216 through a channel C passing the inside of the sealing member 251, the outside-air introduction chamber 250 and the outside-air guide member 221. Incidentally, when the ink cartridge 201 is mounted, the upper end of the outside-air introduction pipe 213 is set to be slightly higher than the upper end of the ink supply pipe 212 or the intermediate wall 251*b* of the sealing member 251 on the outside-air introduction pipe 213 side is set to be slightly lower than the intermediate wall 231*b* of the sealing member 231 on the ink supply pipe 212 side. Thus, the outside-air introduction pipe 213 is allowed to communicate with the ink chamber 216 before the ink supply pipe 212 communicates with the ink chamber 216.

On the other hand, assume that the mounted ink cartridge 201 is pulled up from the mounting portion 203. Then, on the ink supply pipe 212 side, the ink supply pipe 212 itself leaves the intermediate wall 231*b* of the sealing member 231 while the shape of the sealing member 231 is restored due to the elastic force of the sealing member 231. Thus, the first communication hole 232 and the second communication hole 242 are closed to block the channel B. In the same manner, on the outside-air introduction pipe 213 side, the outside-air introduction pipe 213 itself leaves the intermediate wall 251*b* of the sealing member 251 while the shape of the sealing member 251 is restored due to the elastic force of the sealing member 251. Thus, the outside-air introduction hole 252 and the second communication hole 262 are closed to block the channel C. In such a manner, since the channels B and C are blocked in the state where the ink cartridge 201 has been detached from the inkjet recording apparatus 301, ink can be prevented from leaking from the inside of the ink cartridge 201.

According to the ink cartridge 201, as described above, connection or disconnection between the ink chamber 216 and the outside can be selectively changed over due to the elastic force of the sealing members 231 and 251 when the ink cartridge 201 is attached to or detached from the inkjet recording apparatus 301.

In addition, the sealing members 231 and 251 can be installed if they are placed in the ink supply chamber 230 and the outside-air introduction chamber 250 respectively. Not only is it therefore possible to reduce the number of parts, but it is also possible to reduce the man-hour for assembling. Thus, the manufacturing cost can be reduced. Further, since the ink cartridge 201 can be manufactured without using any metal part, it is possible to dispose of the ink cartridge 201 easily.

Also, the outer circumferential portion 231*c* of the sealing member is located in the ink supply chamber 230 substantially all over the length thereof in the axial direction, and includes a second communication hole 242 penetrating the outer circumferential portion of the sealing member in a position where the second communication hole is not opposed to the first communication hole; and the outer circumferential portion of the sealing member is substantially in close contact with the inner wall surface of the ink supply chamber so as to block off between the first communication hole and the second communication hole, while the outer circumferential portion makes the ink chamber communicate with the ink supply member through the first and second communication holes as soon as the outer circumferential portion leaves the inner wall surface of the ink supply chamber.

The outer circumferential portion 231*c* of the sealing member is located in the ink supply chamber so as to extend substantially all over its length in the axial direction. The outer circumferential portion has a second communication hole 242 penetrating the outer circumferential portion in a position where the second communication hole is not opposed to the first communication hole. Therefore, when the outer circumferential portion is substantially in close contact with the inner wall surface of the ink supply chamber, communication between the first communication hole and the second communication hole is disconnected. When the ink supply member is inserted so that the outer circumferential portion leaves the inner wall surface of the ink supply chamber, the ink chamber and the ink supply member communicate with each other through the first communication hole and the second communication hole. Thus, connection and disconnection between the ink chamber and the ink supply member can be secured.

Further, in the ink cartridge 201, the intermediate portion 231*b* of the sealing member is formed integrally with the outer circumferential portion of the sealing member and inside the outer circumferential portion at a distance from each of opposite ends of the outer circumferential portion so as to serve as a wall dividing the inside of the outer circumferential portion substantially into two parts.

The intermediate portion 231*b* of the sealing member is formed integrally with the outer circumferential portion of the sealing member and inside the outer circumferential portion at a distance from each of opposite ends of the outer circumferential portion so as to serve as a wall dividing the inside of the outer circumferential portion substantially into two parts. Accordingly, the outer circumferential portion 231*c* is deformed largely in accordance with the deformation of the intermediate portion so that the outer circumferential portion as a whole can be separated from the inner wall surface of the ink supply chamber. Thus, an ink channel can be formed even if the second communication hole is provided in any position of the outer circumferential portion.

Also, the second communication hole 242 is formed in the outer circumferential portion on one side with respect to the intermediate portion, and the ink supply member is inserted into an internal space of the outer circumferential portion on the one side.

The second communication hole 242 is formed in the outer circumferential portion on one side with respect to the intermediate portion, and the ink supply member is inserted into an internal space of the outer circumferential portion on the one side. Accordingly, ink allowed to flow into the internal space of the outer circumferential portion through the second communication hole 242 can be surely supplied to the recording head through the ink supply member. In addition, the second communication hole 242 is formed in the outer circumferential portion which is on the insertion side of the ink supply member. Accordingly, the distance between the second communication hole 242 and the ink supply member becomes closer than that when the second communication hole 242 is formed in the outer circumferential portion on the other side. Thus, the channel where ink circulates becomes so short that the resistance generated by the ink flowing through the channel is also reduced. As a result, the ink circulating efficiency is improved.

Also, the outer circumferential portion 231*d* on the other side with respect to the intermediate portion is formed to be inclined inward with respect to an extended plane of the outer circumferential portion on the one side.

The outer circumferential portion 231*d* on the other side with respect to the intermediate portion is formed to be inclined inward with respect to an extended plane of the outer circumferential portion on the one side. Accordingly, as soon as the intermediate portion is bent and deformed by the ink supply member, the front end of the outer circumferential portion on the other side abuts against the inner wall surface of the ink supply chamber and moves inward. Thus, the outer circumferential portion on the one side is separated largely from the inner wall of the ink supply chamber so that an ink channel can be formed surely.

Furthermore, the ink supply chamber 230 is defined by the inner wall surface located outside the outer circumferential portion of the sealing member, and two end surfaces located in opposite ends of the ink supply chamber in the axial direction and for regulating movement of the sealing member in the axial direction, while one of the end surfaces is formed by a cover member 233 having an insertion hole 234 for inserting the ink supply member thereto.

The ink supply chamber 230 is formed by the inner wall surface abutting against the outer circumferential portion of the sealing member, and two end surfaces for regulating movement of the sealing member in the axial direction. One of the end surfaces is formed out of a cover member 233 having an insertion hole 234 for inserting the ink supply member thereto. The cover member 233 covers an opening opposed to the other end surface. Accordingly, the movement of the sealing member can be regulated in the ink supply chamber when the opening is covered with the cover member after the sealing member is disposed in the ink supply chamber. It is therefore possible to prevent the sealing member from being displaced or inclined. It is therefore possible to assemble the ink cartridge easily, and it is possible to prevent ink from leaking from a gap between the outer wall surface of the sealing member and the inner wall surface of the ink supply chamber due to displacement or inclination of the sealing member.

In addition, the ink supply chamber 230 and the ink chamber 216 are separated by a partition wall forming the inner wall surface and the other end surface, and the partition wall is connected integrally with a bottom wall of the casing forming the ink chamber so that the inner wall surface rises from the bottom wall inside the ink chamber; and the first communication hole is formed in a joint portion between the partition wall and the bottom wall.

The first communication hole is formed in a joint portion between a partition wall for separating the ink supply chamber 230 and the ink chamber 216 from each other, and a bottom wall 201*c* of the casing. The partition wall is connected integrally with the bottom wall so as to rise from the bottom wall inside the ink chamber. Accordingly, ink can be used up till the ink level in the ink chamber reaches a position as low as the joint portion, so that the ink use efficiency can be improved.

Also, the insertion hole 234 of the cover member is in contact with an outer circumference of the ink supply member while securing sealing therewith.

The insertion hole 234 of the cover member is in contact with an outer circumference of the ink supply member while securing sealing therewith. Accordingly, it is possible to surely prevent ink from leaking from the insertion hole when the ink supply member has been inserted into the insertion hole.

Moreover, the inkjet recording apparatus 301 further includes a hollow outside-air introduction member 4A for introducing the outside air into the ink chamber, the outside-air introduction member being provided to project from the ink-jet recording apparatus; the ink cartridge further includes an outside-air introduction chamber 250 to which the outside-air introduction member is inserted for introducing the outside air into the ink chamber, an outside-air introduction hole for securing communication between the ink chamber and the outside-air introduction chamber, and a second elastic sealing member provided in the outside-air introduction chamber and for closing the outside-air introducing hole, the second elastic sealing member making the outside-air introduction hole communicate with the outside-air introduction member due to insertion of the outside-air introduction member into the outside-air introduction chamber; wherein the second elastic sealing member is formed to have the same shape as the sealing member.

The second elastic sealing member 251 provided in the outside-air introduction chamber so as to close the outside-air introduction hole is formed to have the same shape as the elastic sealing member provided in the ink supply chamber. Accordingly, those sealing members are compatible. Thus, the manufacturing cost of the ink cartridge can be reduced.

Although the invention has been described above based on its embodiment, the invention is not limited to the embodiment at all. It can be imagined easily that various improvements and modifications can be made on the invention without departing from the gist of the invention.

For example, although the inclined parts 231*d* and 251*d* are provided in the sealing members 231 and 251 respectively in the aforementioned embodiment, each sealing member may be formed into a straight cylindrical or prismatic shape all over its outer circumference.

Although the ink supply pipe 212 and the outside-air introduction pipe 213 are formed to have rounded front ends respectively in the aforementioned embodiment, the ink supply pipe 212 and the outside-air introduction pipe 213 may be formed to have substantially planar front ends respectively. That is, the front ends may have any shapes if they are not sharp-pointed but can prevent the sealing members from deteriorating.

Although the partition walls 235 and 255 rise from the body casing 201*a* on the ink chamber 216 side so as to form the ink supply chamber 230 and the outside-air introduction chamber 250 respectively in the aforementioned embodiment, the ink supply chamber 230 and the outside-air introduction chamber 250 may be formed outside the body casing 201*a*. In this case, the first communication hole 232 and the outside-air introduction hole 252 may be formed in the body casing 201*a* while the partition walls 235 and 255 are formed to project outside the body casing 201*a* so as to cover the first communication hole 232 and the outside-air introduction hole 252.

What is claimed is:

1. An ink cartridge comprising:

an ink tank for reserving ink; and a joint connected to the ink tank, the joint including an outer frame having an ink channel formed to secure communication between the ink tank and the outside, and a sealing member made of an elastic material and received in the outer frame, the sealing member having a cylindrical portion and a valve portion integrally;

wherein when an ink supply pipe having an ink inlet is inserted into the cylindrical portion, the cylindrical portion abuts against an outer circumference of the ink supply pipe on an ink flow downstream side of the ink supply pipe with respect to the ink inlet, so as to close the ink channel; and the valve portion abuts against the outer frame so as to close the ink channel when the ink supply pipe is not inserted into the cylindrical portion, and the valve portion leaves the outer frame so as to open the ink channel when the ink supply pipe is inserted into the cylindrical portion.

2. The ink cartridge according to claim 1, wherein the cylindrical portion and the valve portion are integrally molded.

3. The ink cartridge according to claim 1, wherein the outer frame is made from resin, and the sealing member is made from flexible resin.

4. The ink cartridge according to claim 1, wherein the valve portion has a to-be-pressed portion to be pressed onto a front end of the ink supply pipe when the ink supply pipe is inserted, a deformation portion to be deformed when the to-be-pressed portion is pressed, and a closing portion to be brought into close contact with the outer frame to thereby close the ink channel; and the closing portion is displacable between a closing position where the closing portion is brought into close contact with the outer frame in accordance with a shape of the deformation portion, and a separation position where the closing portion leaves the outer frame.

5. The ink cartridge according to claim 1, wherein the valve portion has a plate-like portion extending in a direction perpendicular to an insertion direction of the ink supply pipe; and an outer edge of the plate-like portion of the valve portion is brought into close contact with an inner wall of the outer frame due to elastic force to thereby close the ink channel when the ink supply pipe is not inserted into the cylindrical portion, while the plate-like portion of the valve portion is elastically deformed to allow the outer edge of the plate-like portion leave the inner wall of the outer frame to thereby open the ink channel when the ink supply pipe is inserted into the cylindrical portion.

6. The ink cartridge according to claim 1, wherein the outer frame has in an ink-tank-side end portion thereof an opening for forming the ink channel;

the valve portion has an expansion portion urged due to elastic deformation of the sealing member itself in a direction to close the opening and having a larger diameter than a diameter of the opening; and the expansion portion closes the opening due to urging force applied thereto so as to close the ink channel when the ink supply pipe is not inserted into the cylindrical portion, while the expansion portion leaves the opening against the urging force so as to open the ink channel when the ink supply pipe is inserted into the cylindrical portion.

7. The ink cartridge according to claim 1, wherein the outer frame has in an ink-tank-side end portion thereof an opening for forming the ink channel;

the valve portion has a plate-like portion extending in a direction perpendicular to an insertion direction of the ink supply pipe, and an expansion portion urged due to elastic deformation of the sealing member itself in a direction to close the opening and having a larger diameter than a diameter of the opening; and an outer edge of the plate-like portion of the valve portion is brought into close contact with an inner wall of the outer frame due to elastic force and the expansion portion of the valve portion closes the opening due to urging force applied thereto, so as to close the ink channel, when the ink supply pipe is not inserted into the cylindrical portion, while the plate-like portion of the valve portion is elastically deformed to allow the outer edge of the plate-like portion to leave the inner wall of the outer frame and the expansion portion of the valve portion leaves the opening against the urging force, so as to open the ink channel, when the ink supply pipe is inserted into the cylindrical portion.

8. The ink cartridge according to claim 1, wherein the valve portion has a cylindrical deformation portion connected to the cylindrical portion;

the outer frame has an opening for forming the ink channel, and a region opposed to the cylindrical deformation portion; and the cylindrical deformation portion closes the opening due to elastic force so as to close the ink channel when the ink supply pipe is not inserted into the cylindrical portion, while the cylindrical deformation portion of the valve portion is elastically deformed to leave the opening so as to open the ink channel when the ink supply pipe is inserted into the cylindrical portion.

9. The ink cartridge according to claim 1, wherein at least a part of the sealing member is fixed to the outer frame by an adhesive agent.

10. The ink cartridge according to claim 1, wherein at least a part of the sealing member is fixed to the outer frame by engagement therewith.

11. The ink cartridge according to claim 1, wherein all of constituent members of the ink cartridge including the sealing member are made from combustible materials.

12. An ink cartridge comprising:

an ink tank for reserving ink; and a joint connected to the ink tank, the joint including an outer frame having an atmosphere channel formed to secure communication between the ink tank and the outside, and a sealing member made of an elastic material and received in the outer frame, the sealing member having a cylindrical portion and a valve portion;

wherein when an atmosphere introduction pipe having an atmosphere outlet is inserted into the cylindrical portion, the cylindrical portion abuts against an outer circumference of the atmosphere introduction pipe on a gas flow upstream side of the atmosphere introduction pipe with respect to the atmosphere outlet, so as to close the atmosphere channel; and the valve portion abuts against the outer frame so as to close the atmosphere channel when the atmosphere introduction pipe is not inserted into the cylindrical portion, while the valve portion leaves the outer frame so as to open the atmosphere channel when the atmosphere introduction pipe is inserted into the cylindrical portion.

13. The ink cartridge according to claim 12, wherein the sealing member is a single-piece component integrally having the cylindrical portion and the valve portion.

14. An inkjet recording apparatus comprising:

an ink cartridge; and an atmosphere introduction pipe having an atmosphere outlet;

wherein the ink cartridge comprises:

an ink tank for reserving ink; and a joint connected to the ink tank, the joint including an outer frame having an atmosphere channel formed to secure communication between the ink tank and the outside, and a sealing member made of an elastic material and received in the outer frame, the sealing member having a cylindrical portion and a valve portion;

when the atmosphere introduction pipe is inserted into the cylindrical portion, the cylindrical portion abuts against an outer circumference of the atmosphere introduction pipe on a gas flow upstream side of the atmosphere introduction pipe with respect to the atmosphere outlet, so as to close the atmosphere channel; and the valve portion abuts against the outer frame so as to close the atmosphere channel when the atmosphere introduction pipe is not inserted into the cylindrical portion, while the valve portion leaves the outer frame so as to open the atmosphere channel when the atmosphere introduction pipe is inserted into the cylindrical portion.

15. The inkjet recording apparatus according to claim 14, wherein the sealing member is a single-piece component integrally having the cylindrical portion and the valve portion.

16. An inkjet recording apparatus comprising:

an ink cartridge; and an ink supply pipe having an ink inlet;

wherein the ink cartridge comprises:

an ink tank for reserving ink; and a joint connected to the ink tank, the joint including an outer frame having an ink channel formed to secure communication between the ink tank and the outside, and a sealing member made of an elastic material and received in the outer frame, the sealing member having a cylindrical portion and a valve portion integrally;

when the ink supply pipe is inserted into the cylindrical portion, the cylindrical portion abuts against an outer circumference of the ink supply pipe on an ink flow downstream side of the ink supply pipe with respect to the ink inlet, so as to close the ink channel; and the valve portion abuts against the outer frame so as to close the ink channel when the ink supply pipe is not inserted into the cylindrical portion, and the valve portion leaves the outer frame so as to open the ink channel when the ink supply pipe is inserted into the cylindrical portion.

* * * * *